United States Patent [19]

Kikuchi et al.

[11] 4,445,680

[45] May 1, 1984

[54] SHEET DISTRIBUTION METHOD

[75] Inventors: Hideo Kikuchi; Tamaki Kaneko, both of Tokyo, Japan

[73] Assignee: Ricoh Company, Ltd., Tokyo, Japan

[21] Appl. No.: 190,287

[22] Filed: Sep. 24, 1980

[30] Foreign Application Priority Data

Sep. 28, 1979 [JP] Japan ..... 54-124873

[51] Int. Cl.[3] ..... B65H 39/11

[52] U.S. Cl. ..... 271/290; 271/296

[58] Field of Search ..... 271/288, 289, 290, 287, 271/296, 297

[56] References Cited

U.S. PATENT DOCUMENTS

| | | | |
|---|---|---|---|
| 3,830,590 | 8/1974 | Harris et al. | 271/290 X |
| 4,200,386 | 4/1980 | Queener | 271/287 X |
| 4,285,508 | 8/1981 | Kaneko | 271/290 |

*Primary Examiner*—Bruce H. Stoner, Jr.

*Attorney, Agent, or Firm*—David G. Alexander

[57] ABSTRACT

A sheet distribution method for collating a plurality of sets of copies produced by a copying machine into respective bins of a collating apparatus operatively connected to the copying machine, each set of copies consisting of one copy of each respective page of an original document, includes the steps of providing a first display unit, displaying a total number of sets of copies to be produced and collated on the first display unit, computing whether the total number of sets is greater than a number of available bins in the collating apparatus, when the total number of sets is smaller than the number of available bins, collating the sets of copies into the respective bins in a single collation operation, when the total number of sets is greater than the number of available bins, collating the sets of copies into the respective bins in a plurality of successive collation operations, providing a second display unit, during collation of a page of the document by the collating apparatus, computing a total number of copies of the page which have been collated, and displaying the total number of copies on the second display unit. The total number of copies is obtained by counting a number of copies of the page which have been collated during a present collation operation to provide a count, computing a previous number of sets of copies which were collated during previous collation operations and adding the count to the previous number of sets to provide the total number of copies.

4 Claims, 47 Drawing Figures

9.6
JAM FLAG = 1 ?
NO
YES
9.7
RESET SHEET FEED COUNTER
10.1
SHEET CHECK AT SHEET FEED STATION
NO
YES
10.2
SHEET FEED COUNTER+1
10.3
P2 FLAG = 1 ?
10.5
DISPLAY SHEET FEED COUNTER + S3 REGISTER
10.6
NO
VOLUME NUMBER = SHEET FEED COUNTER ?
DISPLAY COUNT OF SHEET FEED COUNTER
10.4
10.7
YES
RESET JAM FLAG
STOP SHEET FEED

SHEET DISTRIBUTION METHOD

BACKGROUND OF THE INVENTION

The present invention relates to a sheet distribution method for performing sheet distribution operations such as collating and sorting and, more particularly, relates to a display control system for a copying machine equipped with a plurality of collating apparatus or collators.

Generally, a collator includes a sheet conveyance path, a plurality of sheet storage bins and a deflecting device which is movable to deliver sheets into the bins. This type of collator is usually designed for selective operation in any one of collation and assortment modes as desired. The collation mode refers to an operation mode wherein sheets on the same page are delivered one by one into different bins whereas the assortment mode refers to an operation mode wherein a given number of sheets are fed out continuously into a certain bin and then into the next bin when the first bin becomes full. Despite that the number of available bins is limited, it is sometimes desired to collate or assort a relatively large number of volumes which exceeds the total number of bins. In such a case, the input apparatus associated with the collator as typified by a copying or printing machine should preferably process all the volumes of sheets as one sheet feed cycle without any dwell in its operation. With these in view, it has been a common practice to connect some collators in series with the input apparatus and use them such that sheets are supplied to the first collator, then to the second when the capacity of the first is reached, then to the third when the capacity of the second is reached and so on.

Series connection of multiple collators will in this way facilitate collation or assortment of large numbers of volumes. However, this requires a disproportionate cost and a disproportionate space for installation since it is quite rare to process such large numbers of volumes in ordinary office work. Usually, what determines the least possible number of collators connected together is the user's judgement concerning the range of volumes which they deal with most frequently. The number of interconnected collators is thus dependent on the user. Considering the tendency to the use of the least number of collators and the number which depends on the user, it is desirable to uniformalize the manners of handling copiers and collators and to use the limited number of collators efficiently for collation or assortment even though the intended number of volumes may exceed the total number of bins of interconnected collators.

Where "Q" collators are interconnected in series and each collator has "B" bins therein, the total number of bins in the collators is expressed as BQ and this is usually the ability of all the interconnected collators for one time of collation or assortment (total processing ability). Commonly, some of the "Q" collators are empty with no sheets loaded in their bins. This condition may exist when the last operator interrupted collation or assortment halfway or when he failed to remove copy sheets from the bins of the collators after collation or assortment. Supposing that "q" collators of the "Q" collators are empty, the total number of bins of the empty collators or their effective processing ability is Bq.

Thus, a storage register is employed to store a designated number of volumes N to be collated irrespective of the total processing ability of collators. Collation data N in this register is compared with the total processing ability BQ and effective processing ability Bq. If the data N is smaller than the effective processing ability of the collators, copy sheets will be collated using the empty collators. When the data N is smaller than the total processing ability BQ but larger than the effective processing ability Bq, the empty collators will be used to perform multiple times of repeated collation. When the effective processing ability Bq is zero meaning that no empty collators exist, collation will not be performed. It should be born in mind that, though not described herein, the copying machine is operable even if collation or assortment does not occur. Furthermore, where the data N in the register is larger than the total processing ability of the collators, collation or assortment will preferably be carried out if there is any effective processing ability Bq and not if the effective processing ability Bq is zero. In this instance, visual indication for the operator is important in simplifying handling of the system. Where the collation data is larger than the total processing ability BQ but smaller than the effective processing ability Bq, it is unadvisable in view of the document replacement to process the desired number of volumes by dividing them into multiple groups if the effective processing ability is not zero. This is because, in the case of collation, after the first collation wherein copy sheets on determined pages are repeatedly delivered, the same pages of documents need be replaced by one another for the second collation for the remaining volumes. Thus, as an alternative to such a method, collation may not be performed when the number of desired volumes is less than BQ but larger than Bq. However, that collation is disabled even when all the collators are empty is contradictory to general needs; this is an exceptional case wherein collation will be performed repeatedly by dividing the desired number of volumes. Again, the display for the operation is of consequence with a view to simplifying the handling of the system.

SUMMARY OF THE INVENTION

A sheet distribution method for collating a plurality of volumes or sets of copies produced by a copying machine into respective bins of a collating apparatus operatively connected to the copying machine, each volume or set of copies consisting of one copy of each respective page of an original document, comprises the steps of providing first display means, displaying a total number of sets of copies to be produced and collated on the first display means, computing whether the total number of sets is greater than a number of available bins in the collating apparatus, when the total number of sets is smaller than the number of available bins, collating the sets of copies into the respective bins in a single collation operation, when the total number of sets is greater than the number of available bins, collating the sets of copies into the respective bins in a plurality of successive collation operations, providing second display means, during collation of a page of the document by the collating apparatus, computing a total number of copies of said page which have been collated; and displaying the total number of copies on the second display means. The total number of copies is obtained by counting a number of copies of said page which have been collated during a present collation operation to provide a count, computing a previous number of sets of copies which were collated during previous collation operations and adding said count to the previous number of sets to provide the total number of copies.

It is an object of the present invention to provide a sheet distribution method in which an operator can efficiently use collators without any troublesomeness and thereby collate or assort a desired number of volumes with ease.

It is another object of the present invention to provide a generally improved sheet distribution method.

Other objects, together with the foregoing, are attained in the embodiment described in the following description and illustrated in the accompanying drawings.

BRIEF DESCRIPTION OF THE DRAWINGS

FIGS. 8*a*, 8*b* and 8*c* in combination constitute a block diagram of a control device;

FIGS. 9*a*-1 and 9*a*-2 are combined to constitute a flow chart demonstrating a control method embodying the present invention;

FIGS. 9*a*-1 and 9*a*-2 in combination constitute a flow chart demonstrating a control method embodying the present invention;

FIGS. 9*b*-1 and 9*b*-2 are combined to constitute a flow chart demonstrating a control method embodying the present invention;

FIGS. 9*b*-1 and 9*b*-2 in combination constitute a flow chart demonstrating a control method embodying the present invention;

FIGS. 9*c*-1 and 9*c*-2 are combined to constitute a flow chart demonstrating a control method embodying the present invention;

FIGS. 9*c*-1 and 9*c*-2 in combination constitute a flow chart demonstrating a control method embodying the present invention;

FIGS. 9*d*-1 and 9*d*-2 are combined to constitute a flow chart demonstrating a control method embodying the present invention;

FIGS. 9*d*-1 and 9*d*-2 in combination constitute a flow chart demonstrating a control method embodying the present invention;

FIGS. 9*e*-1, 9*e*-2 and 9*e*-3 are combined to constitute a flow chart demonstrating a control method embodying the present invention;

FIGS. 9*e*-1, 9*e*-2 and 9*e*-3 in combination constitute a flow chart demonstrating a control method embodying the present invention;

FIGS. 9*f*-1 and 9*f*-2 are combined to constitute a flow chart demonstrating a control method embodying the present invention;

FIGS. 9*f*-1 and 9*f*-2 in combination constitute a flow chart demonstrating a control method embodying the present invention;

FIGS. 9*g*-1, 9*g*-2 and 9*g*-3 are combined to constitute a flow chart demonstrating a control method embodying the present invention;

FIGS. 9*g*-1, 9*g*-2 and 9*g*-3 in combination constitute a flow chart demonstrating a control method embodying the present invention;

FIG. 10 is a diagram illustrating how

FIGS. 10*a* and 10*b* in combination constitute a flow chart demonstrating a control method embodying the present invention;

FIGS. 11*a*, 11*b* and 11*c* in combination constitute a flow chart demonstrating a control method embodying the present invention;

DESCRIPTION OF THE PREFERRED EMBODIMENT

While the sheet distribution method of the present invention is susceptible of numerous physical embodiments, depending upon the environment and requirements of use, substantial numbers of the herein shown and described embodiments have been made, tested and used, and all have performed in an eminently satisfactory manner.

Figure 1:
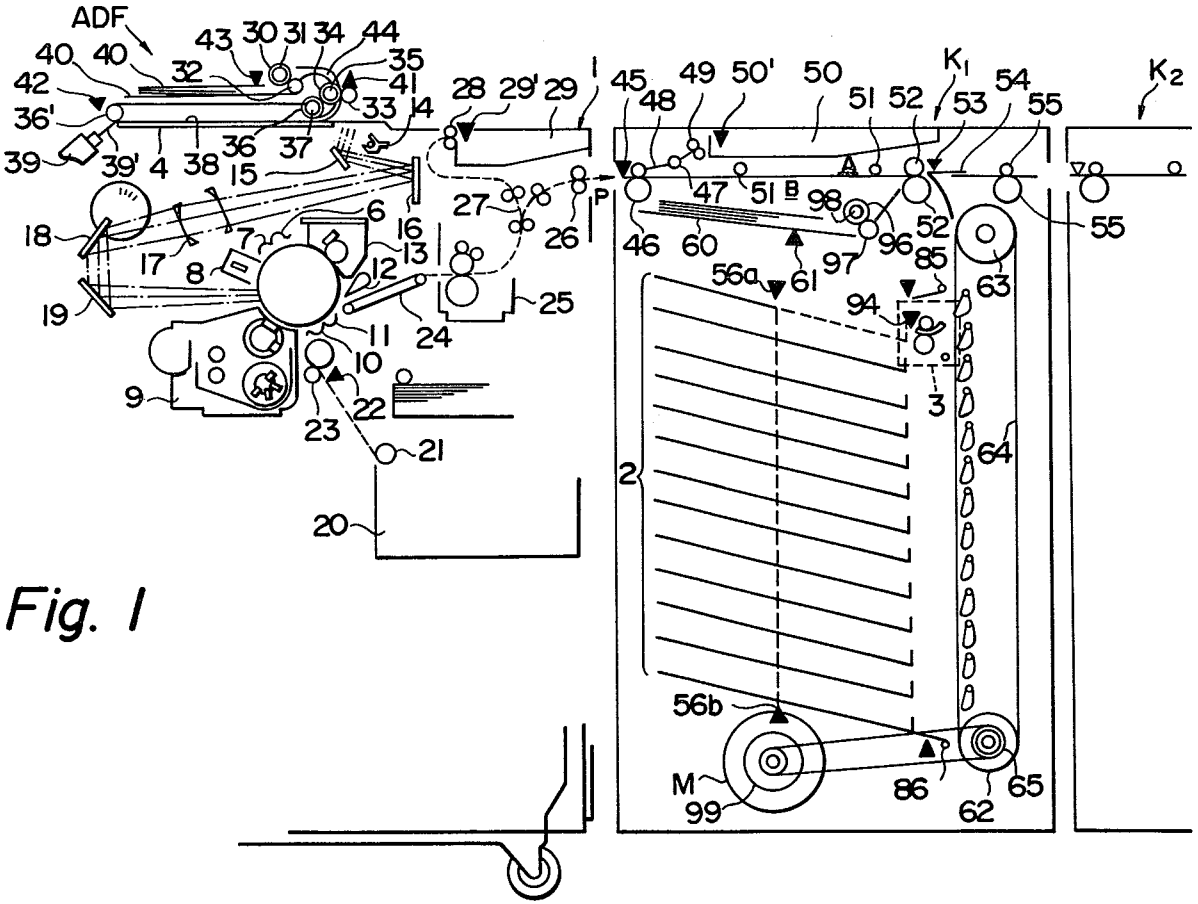
FIG. 1 shows an overall arrangement of a document copying system controlled by a method of the present invention.

Referring now to FIG. 1 of the drawings, there are shown first and second collators $K_1$ and $K_2$ adjoining a copying machine 1 in succession. An automatic document handling device ADF is layed on the glass platen 4 of the copying machine 1.

The copying machine 1 includes a photosensitive drum 5 which is surrounded at individual stations by a first charger 6 for expelling electrostatic charge, second charger 7 for depositing electrostatic charge, discharging lamp 8, developing unit 9, third charger 10 for image transfer, fourth charger 11 for sheet separation, separator pawl 12 and cleaning unit 13. Denoted by the reference numeral 14 is a halogen lamp serving as a scanner of a slit exposure system. The surface of the drum 5 is first processed to carry electrostatic charge thereon. The halogen lamp 14 moves to illuminate a document layed on the glass platen 4 while light reflected from the document is redirected by first and second mirrors 15 and 16. Light from the second mirror 16 passes through a through lens 17 and then reflected by third and fourth mirrors 18 and 19 onto the charged surface of the drum 5 through a determined slit. This exposure forms an electrostatic latent image on the drum surface. The developing unit 9 processes the latent image with toner particles into a visible toner image. By this time, a paper sheet will have been fed out from a sheet feed section 20 by sheet feed rollers 21 and reached a stand-by position at a pair of registration rollers 23. The registeration rollers 23 advance the paper sheet at a timing suitable to overlay it on the toner image on the rotating drum 5. The charger 10 transfers the toner image from the drum to the paper sheet whereupon the sheet is separated from the drum surface by the charger 11 and separator pawl 12. A conveyor 24 takes the paper sheet to a fixing unit 25 therewith. From the fixing unit the paper sheet advances to a path selecting gate 27 which has two different positions. When in a first position which is a usual position, the gate 27 will move copy sheets through rollers 26 to the outside of the machine and into the first collator 2. In a second position indicated by a phantom line, the gate 27 will pass them through a roller pair 28 into a first temporary tray 29. A first temporary discharge detector 29' is associated with the first temporary tray 29. The cleaning unit 13 on the other hand cleans the drum surface for another copying cycle.

In the sheet feed section, a sheet sensor 22 neighbors the sheet catching side of the registration roller pair 23 in order to monitor the feed of sheets.

The automatic document handler ADF on the glass platen 4 has a drive roller 36 at the home position side of the scanner and a driven roller 36' at the other side. An endless conveyor belt 38 is passed over these drive and driven rollers. The drive of the drive roller 36 and therefore that of the belt 38 is controlled by an electromagnetic clutch 37. Disposed above the belt 38 is a document tray 40 which is loaded with a stack of documents 40'. Movable rollers 30 and stationary rollers 32 cooperate to pick up the documents successively one at a time. This sheet pick-up operation is controlled by an electromagnetic clutch 31 which actuates the rollers 30. A document fed by the rollers 30 and 32 moves in the determined direction until it reaches a standby position at a pair of registration rollers 33 and 34 located in a path 44 which extends from the rollers 30 to the inlet end of the belt 38. When the registration roller 34 is driven for rotation by its associated electromagnetic clutch 35, the document in the standby position is advanced through the path 44 to the belt 38. Operated by the clutch 37, the belt 38 moves the document between it and the glass platen 4 until a stop pawl 39' engages the leading end of the document. The stop pawl 39' is located at the other end of the glass platen as shown. When the document on the glass platen is to be replaced by another, a solenoid 39 will be energized to retract the stop pawl 39' and thereby permit the return of the document back onto the tray 40. A sheet sensor 41 is located in the registration roller section, a sheet detector 42 at the outlet end of the belt 38, and a sheet sensor 43 above the document tray 40.

Each of the collators $K_1$, $K_2$, $K_3$ . . . includes a sheet aligning section A, feeder section B defined below the sheet aligning section A, series of bins 2, vertically reciprocatable deflecting device 3 for delivering copy sheets into desired bins, conveyor belt 64 bringing copy sheets from the section A or B to the deflector 3, and motor M.

Figure 2:
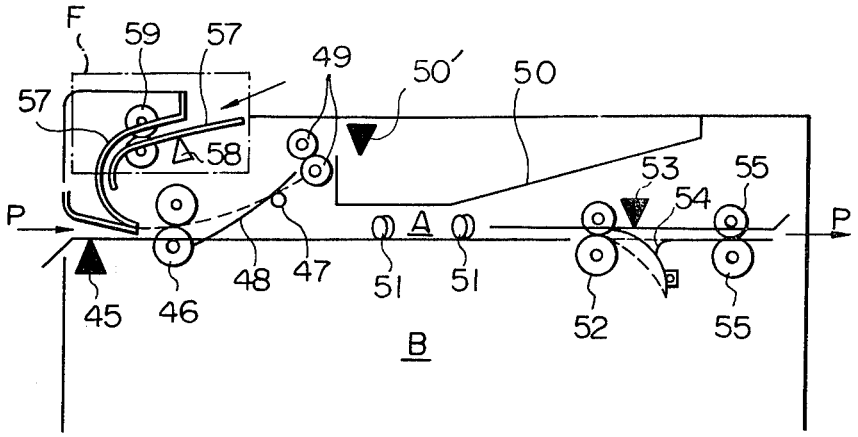
FIG. 2 illustrates a part of sheet aligning section and feeder section of a collator.

As viewed in FIGS. 1 and 2, a copy sheet discharged from the copying machine 1 enters the first collator $K_1$ as indicated by an arrow P. A pair of inlet rollers 46 in the collator nips this sheet while a sheet sensor 45 monitors the movement of the sheet. The roller pair 46 is followed by a guide plate 48 whose position is controlled by a solenoid 47. Usually the guide plate 48 directs the copy sheet horizontally straight to skew rollers 51.

The skew rollers 51 bias the copy sheet toward a reference plate (not shown) so that the copy sheet advances toward a pair of intermediate rollers 52 with its position and orientation determined by the reference plate. When an intermediate guide plate 54 in the feeder section B has a first position indicated by a solid line, the sheet from the intermediate roller pair 52 will be guided toward a conveyor belt 64. When the guide plate 54 is in its second position indicated by a phantom line, the sheet will be transferred to the second collator $K_2$ through a pair of outlet rollers 55. An intermediate sheet sensor 53 is located at the rear of the intermediate roller pair 52. In the event jamming or like trouble occurs in the area past of the skew rollers 51, all the rollers in the collator except the rollers 46 and 49 will stop the rotation and the guide plate will assume the solid line position. Under this condition, copy sheets fed continuously from the copying machine to the collator $K_1$ will be directed to a temporary tray 50 without exception by way of the discharge roller pair 49 and a temporary sheet discharge sensor 50'.

Suppose that it is desired to collate or sort copy sheets collected in the temporary tray 50 or prepared by another copying machine. Then the stack of copy sheets are loaded on a tray 60 and a sheet feed start command is delivered to couple an electromagnetic clutch 98 in the feeder section. The clutch 98 rotates feed rollers 96 which in turn feeds the copy sheets one by one from the sheet atop the stack. As this sheet reaches the intermediate roller pair 52 and detected by the sheet sensor 53, the clutch is uncoupled to interrupt the rotation of the feed rollers 96. Thereafter, the copy sheet is advanced by the intermediate roller pair 52 as discussed. The one-by-one feed of sheets by the feed rollers 96 is ensured by separation rollers 97 which engage the individual feed rollers 96 with a suitable pressure and rotate in the opposite direction to the feed rollers 96 or remain stationary.

As shown in FIG. 2, the collator further includes a manual insertion section F indicated by a dash-and-dot line and usable to collate or sort copy sheets discharged onto the temporary tray 50 in the event of jamming, covers or the like. A sheet is inserted in this section F as indicated by an arrow along a lower guide plate 57. If the collator has been conditioned to permit manual insertion of sheets, a clutch (not shown) is coupled to drive a manual insertion roller 59 for rotation at the instant a sheet sensor 58 detects the sheet inserted. Then the sheet is advanced manually until the roller 59 grips and moves it to the inlet roller pair 46 in cooperation with its associated roller. The feeder section B and sheet aligning section A are hinged to each other along their one edge parallel to the direction P so that the section A can be lifted at the other side. With this arrangement, there can be promoted easy removal of jammed sheets from the transfer path and loading of sheets on the tray 60. A sheet sensor 61 is located in the feeder section to detect sheets on the tray 60.

The conveyor belt 64 is passed over a drive roller 62 and a driven roller 63. The drive roller 62 is operatively connected with a motor M through an electromagnetic clutch 65. An encoder pulse generator 99 is associated coaxially with the motor M.

Figure 3:
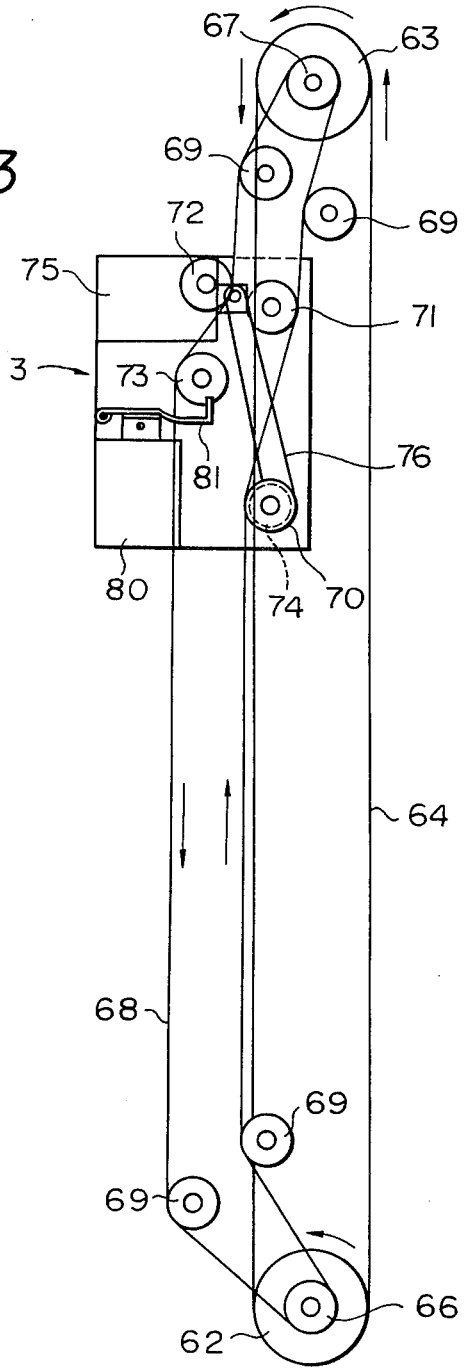
FIG. 3 is a view explanatory of cooperation of a conveying section and a deflecting device in a collator.

As viewed in FIG. 3, a sprocket 66 is fixedly mounted on a shaft which carries the drive roller 62 while a sprocket 67 is movably mounted on a shaft supporting the driven roller 63. A first endless chain 68 runs on these sprockets 66 and 67. The diameter of the sprocket 66 coaxial with the drive roller 62 is smaller than the drive roller 62 and, hence, the travelling speed of the chain 68 is lower than that of the conveyor belt 64. The chain 68 is also passed over sprockets 69 in the conveyor section and sprockets 70, 71, 72 and 73 carried on the deflector 3.

Concerning the deflector 3, it will move upward when its sprocket is fixed to the elevating run of the chain 68 and move downward when fixed to the lowering run of the chain 68 as will be described. A spring clutch 74 is associated with the sprocket 70 mounted on a stationary shaft of the deflector. Operation of this clutch 74 is controlled by a solenoid 75 through a lever 76. When the solenoid 75 is energized, the clutch 74 is uncoupled to render the sprocket 70 freely rotatable on the rigid shaft so that the deflector 3 remains stationary despite the rotation of the chain 68. As the solenoid 75 is deenergized, the lever 76 returns under the action of its associated spring and the sprocket 70 is thereby locked to the rigid shaft through the clutch 74. Then the sprocket 70 and therefore the deflector 3 is bodily movable together with the elevating run of the chain 68. As the deflector 3 rises up to the uppermost position where it is expected to stop, it actuates a home position sensor 85 (FIG. 6) which in turn energizes the solenoid 75. This uncouples the clutch 74 and thereby interrupts the operative connection of the deflector 3 and elevating run of the chain 68.

Figure 4:
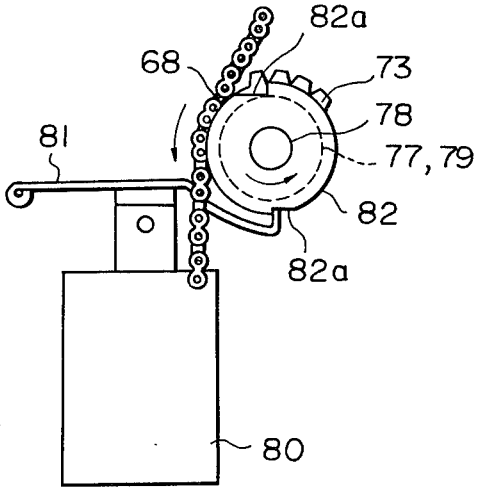
FIG. 4 shows a clutch control mechanism.
Figure 5:
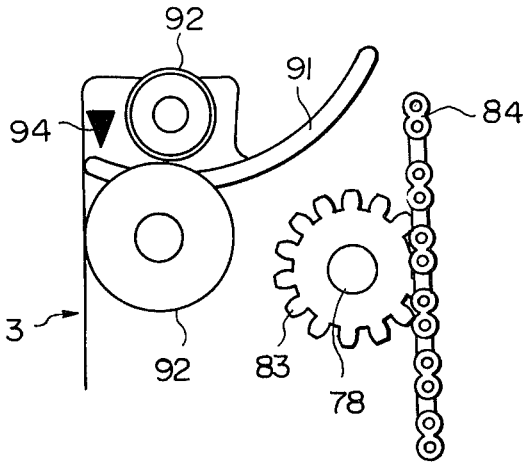
FIG. 5 indicates stepwise feed of the deflector.

Downward movement of the deflector 3 is in principle common to the upward movement mentioned above but must be accurately indexed by each determined amount or module distance. To meet this important requirement, the deflector is provided with various components as shown in FIG. 4: a sprocket 73 constantly meshed with the chain 68, spring clutch 77 associated with the sprocket 73, electromagnetic clutch 79 intervening between the spring clutch 77 and shaft 78, solenoid 80 for coupling and uncoupling the spring clutch 77, lever 81 connected with the plunger of the solenoid 80, and cam sleeve 82 having a notch 82*a* engagable with one end of the lever 81 and adapted to control the operation of the spring clutch 77. Another sprocket 83 is rigid on the shaft 78 as shown in FIG. 5. The sprocket 83 is meshed with a second chain 84 which is fixed in the conveyor section and thus immovable.

When the solenoid 80 is deenergized, the notch 82*a* of the cam sleeve 82 is engaged by the cooperating end of the lever 81 to uncouple the spring clutch 77. Under this condition, rotation of the chain 68 cannot rotate the shaft 78 though rotating the sprocket 73 and the deflector 3 remains stationary. Upon energization of the solenoid 80, the lever 81 disengages from the notch 82*a* of the cam sleeve whereby the spring clutch 77 is coupled transmitting the rotation of the sprocket 73 to the shaft 78 through the clutch 79 which usually remains energized. Then the sprocket 83 rotates together with the shaft 78 and in this way rolls down along the immovable chain 84 moving the deflector 3 bodily downward. Immediately after the release of the lever 81 from the notch 82*a* of the cam sleeve, the solenoid 80 is again deenergized so that the engaging end of the lever 81 slides along the periphery of the rotating cam sleeve 82 while maintaining the engagement. Upon half a rotation of the cam sleeve 82, the engaging end of the lever 81 now engages a second notch 82*a* diametrically opposite to the notch 82*a* interupting the rotation of the cam sleeve 82. Then the spring clutch 77 is reuncoupled to in turn stop the downward movement of the deflector 3 through the shaft 78 and sprocket 83 rigid thereon. In this way, the deflector 3 in its downward movement lowers a distance which exactly corresponds to half a rotation of the cam sleeve 82; this distance corresponds to the spacing between adjacent bins 2.

Figure 6:
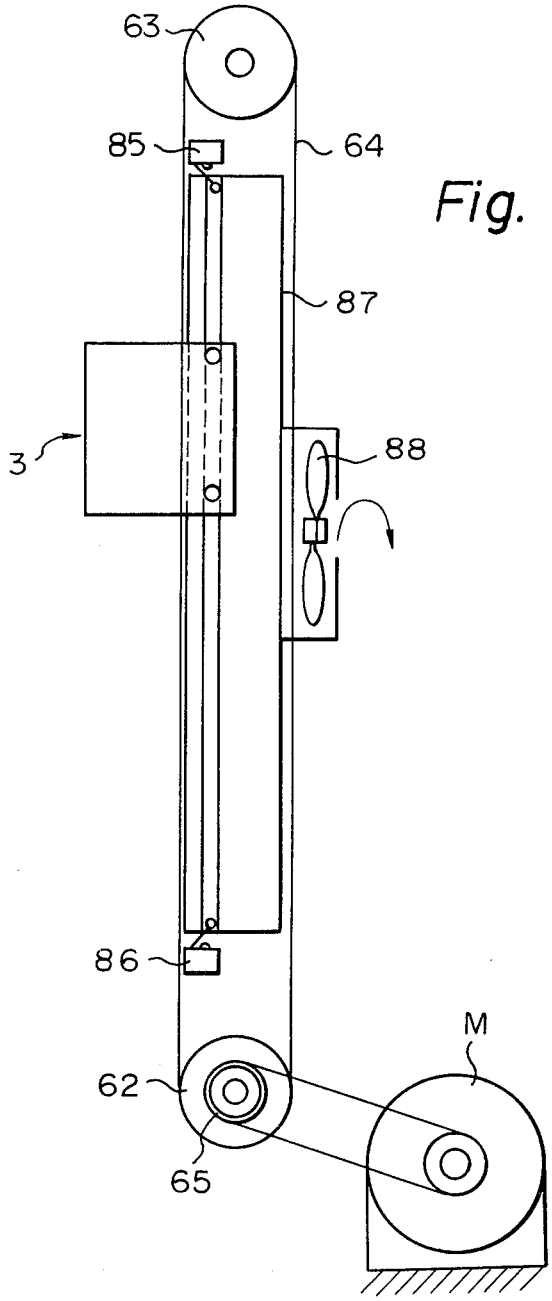
FIG. 6 is a view of the conveying section.

As viewed in FIG. 6, a vacuum chamber 87 is defined between the opposite vertical runs of the conveyor belt 64 passed over the rollers 62 and 63. A blower 88 keeps vacuum constantly within the vacuum chamber 87. The vacuum chamber 87 has numerous apertures through its wall which faces the bins 2 and engages the belt 64. The belt 64 also has apertures corresponding to the apertures of the vacuum chamber wall. A sensor 86 is positioned to detect the end of the downward stroke of the deflector 3. When a copy sheet arrives at a position where the apertures of the belt 64 align with those of the vacuum chamber 87, it is sucked onto the belt 64 and conveyed thereby to the deflector 3. At the deflector 3, a deflecting cam 89 shown in FIG. 7 deflects the copy sheet into a selected bin 2 while a sheet sensor 94 monitors this movement of the copy sheet.

Figure 7:
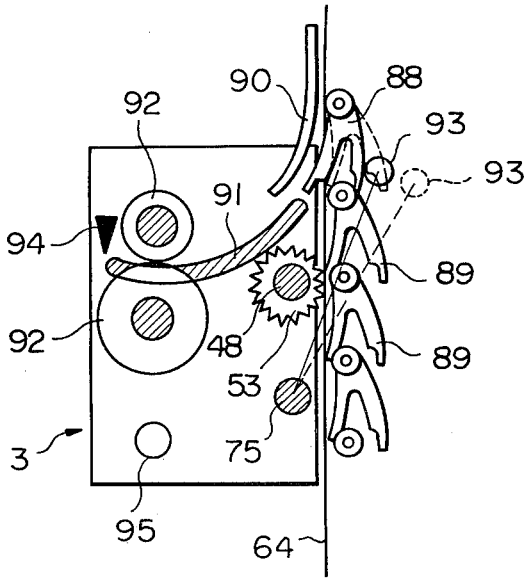
FIG. 7 is a fragmentary view explanatory of cooperation of the deflector and deflecting cams.

More specifically, multiple deflection cams 89 are located in correspondence with the individual bins 2 as shown in FIG. 7 and designed such that one of them associated with a bin at which the deflector has stopped to deliver a copy sheet thereinto projects from the conveyor belt 64. The copy sheet reached the deflector 3 is separated from the working surface of the belt 64 by the curved surface of a projected cam 89 and caused to slide down along successive guides 90 and 91 on the deflector 64. A discharge roller pair 92 catches the copy sheet and discharges it into the particular bin.

The deflector 3 further includes a lever 93 for actuating the cams 89. When the lever 93 is locked in the position indicated by a solid line in FIG. 7, the corresponding cam 89 will be held in a position projected from the working surface of the belt 64. During downward stroke of the deflector 3, the lever 93 holds the solid line position causing desired cams 89 to protrude from the belt surface. During upward movement of the deflector, the lever 93 assumes the position indicated by a phantom line clear of the cams 89. The position of this lever 93 is controlled by the solenoid 75 stated in connection with the elevation of the deflector. When the solenoid 75 is turned off, the deflector 3 will elevate with the lever 75 held in the phantom line position of FIG. 7. With the solenoid 75 turned on, the deflector 3 will wait for energization of the solenoid 80 with the lever 93 held in the solid line position of FIG. 7. A sheet sensor 94 is positioned in the deflecting section to detect a copy sheet. A lamp 95 displays operating conditions of the collator and turns on and off repeatedly in the event of jamming.

In FIG. 1, there is also shown an optical sheet sensor made up of two elements 56*a* and 56*b* and adapted to produce an output signal when detected a sheet or sheets in any one of the bins.

Figure 8:
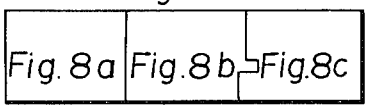
FIG. 8 is a diagram illustrating how
Figure 8A:
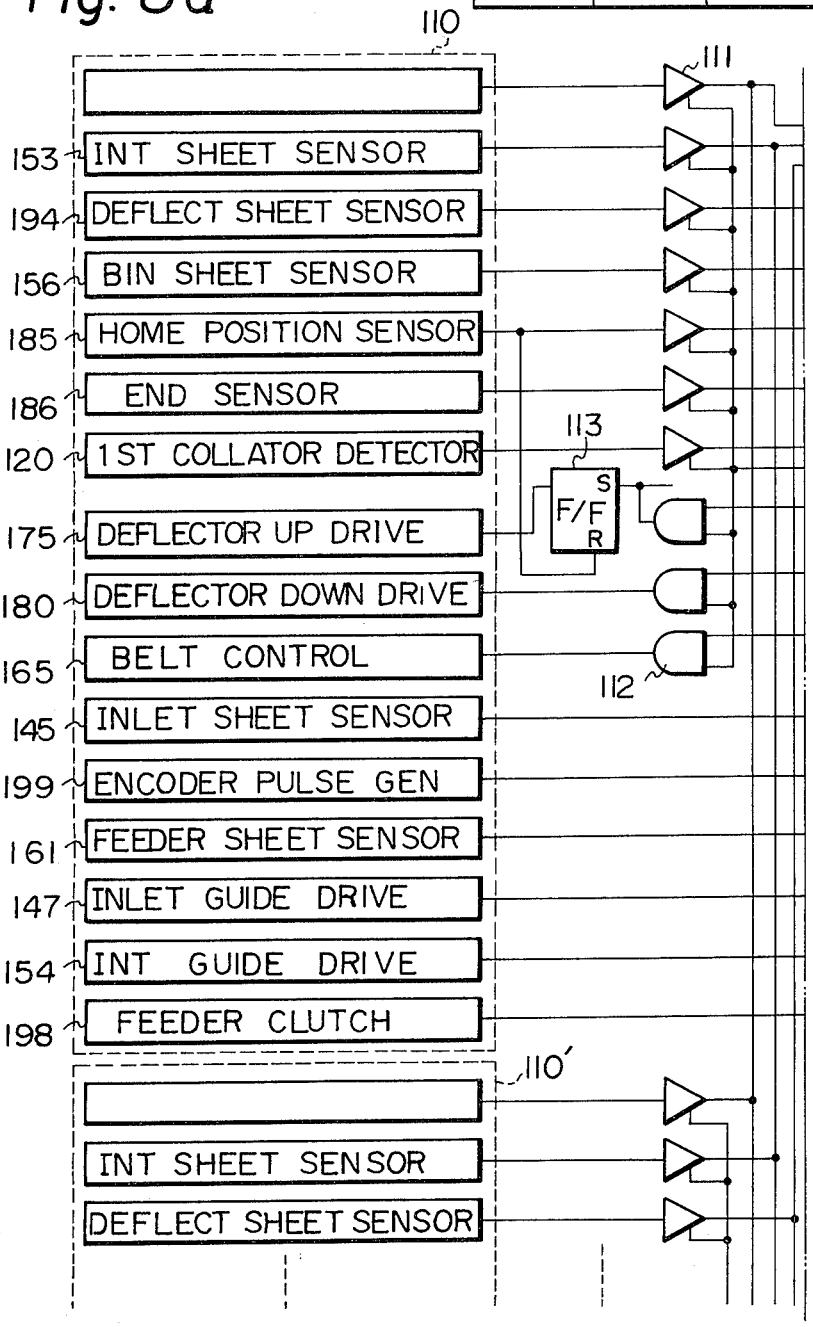
FIGS. 8*a*, 8*b* and 8*c* are combined to constitute a block diagram of a control device.
Figure 8B:
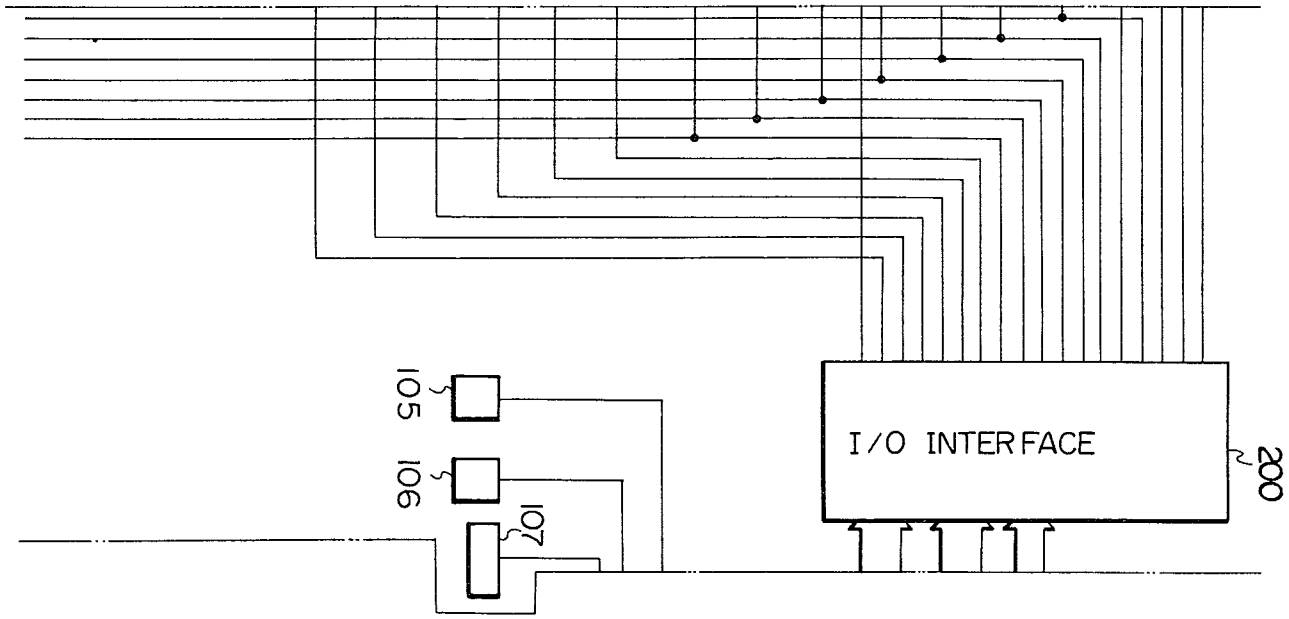
Figure 8C:
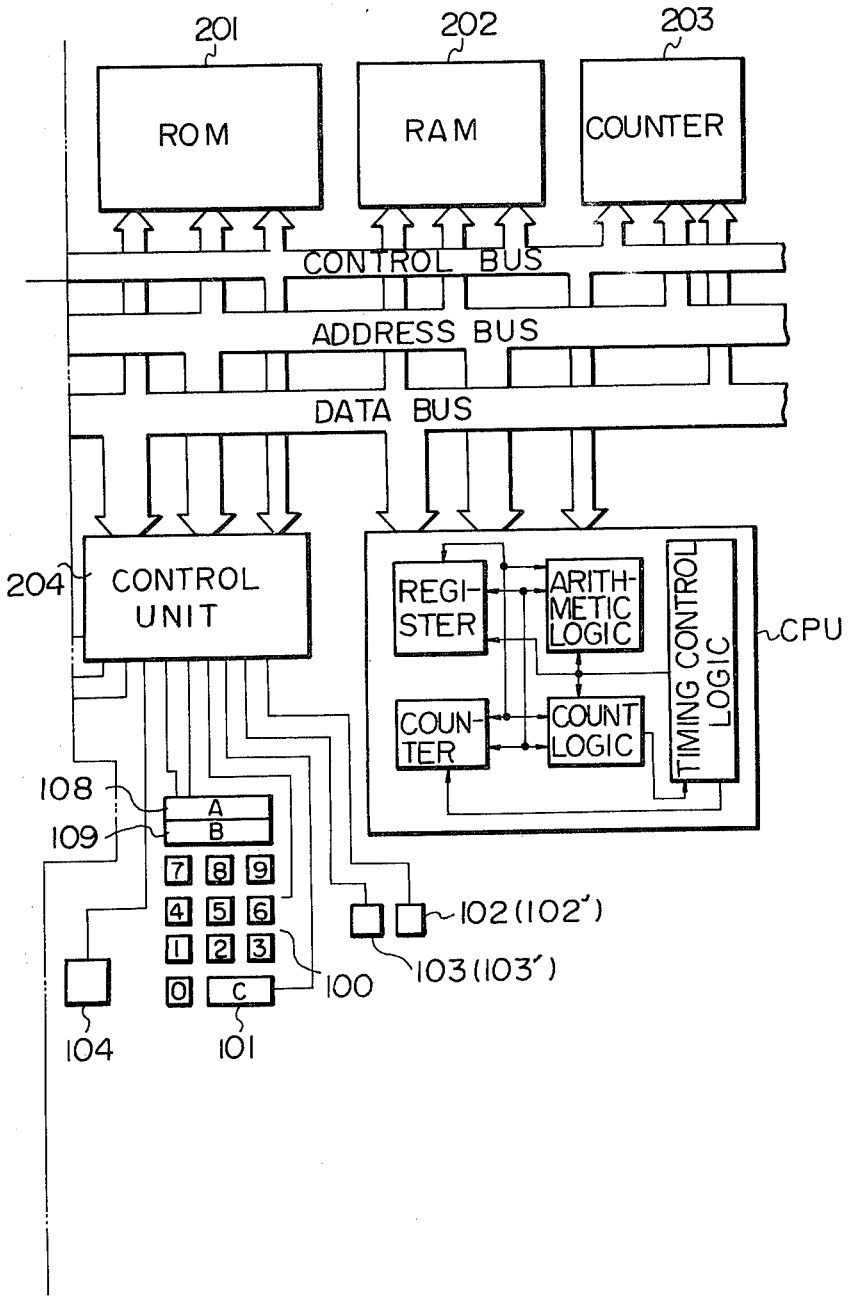

Referring to FIGS. 8*a* to 8*c*, a control circuit for the system discussed above is shown in diagram. The control circuit includes a central processing unit CPU, device 200 having I/O port controlled by the central processing unit CPU, read only memory or ROM 201 and random access memory or RAM 202. A circuit 203 is a pulse counter/jam detector adapted to check jamming by monitoring the time period which a copy sheet takes to reach a desired bin while counting output pulses of an encoder pulse generator 99 under the control of the central processing unit CPU. Thus, the circuit 203 also serves the function of a timer. It should be born in mind that the determined count of the counter 203 is variable. This is because sheet jamming is checked at two different locations in a common collator, one in the path from the inlet sheet sensor 45 to the sheet sensor 94 at the deflecting section and the other in and around the deflecting section to determine whether a sheet has fully moved past the sensor 94, and because the overall length of the path from the sensor 45 to the sensor 94 depends on the position of the deflector 3. The central processing unit CPU also controls the counting system of the counter 203 depending on the mode of operation of the collator, which is either a collation mode or an assortment mode.

A circuit 204 is a keyboard IC display control circuit having therein a random access memory for storing data which the central processing unit CPU is to display, and a segment decoder. Also accommodated in the display control circuit 204 are control circuits associated with numeral keys 100 and mode keys 102 and 103. The key arrangement further includes a clear key 101, collation mode key 102 having a collation display lamp 102' therewith, assortment mode key 103 with an assortment display lamp 103', copy start key 104 and feeder section start key 105. Additionally connected with the display control circuit 204 are a lamp 106 indicating "sheet present in bin", lamp 107 responsive to jamming of sheets, present copy number display section A 108 and fed sheet number display section B 109.

Blocks 110, 110' . . . indicated by phantom lines represent I/O device sets of individual collators $K_1$, $K_2$ . . . In each device set 110, respective devices are indicated by adding "100" to the reference numerals of the corresponding components. Additionally included in the device set 110 are a drive circuit 175 for actuating the solenoid 75 and clutch 79 to elevate the deflector 3 and a circuit associated with each collator to show that said collator is in connection with the control circuit.

In each device set 110, an intermediate sheet sensor circuit 153, deflecting section sheet sensor circuit 194, bin sheet sensor circuit 156, home position sensor circuit 185, end sensor circuit 186 and connected collator detector circuit 120, which are input components of the I/O devices except those concerned with the temporary tray 50 and feeder section B, are individually connected with the device 200 through muptiplexers which employ tristates 111. Meanwhile, output I/O devices of the device set which are an elevation drive circuit 175, loweration drive circuit 180 and belt control circuit 165 are connected with the device 200 through multiplexers using 2-input AND gates 112 individually. With this arrangement, a desired collator can be activated automatically by supplying a common selection signal to the control terminals of the tristates 111 and the other input terminals of the AND gates 112 associated with the intended collator. A flip-flop 113 precedes the elevation drive circuit 175 and it will be set by an output of the home position sensor 185 when the deflector regains its home position. The rest of the I/O devices in each group 110, i.e., inlet sheet sensor 145, encoder pulse generator 199, feeder section sheet sensor 161, inlet guide drive circuit 147, intermediate guide drive circuit 154 and feeder section clutch 198, are connected directly with the device 200.

Figure 11:
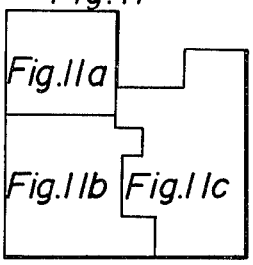
FIG. 11 is a diagram illustrating how
Figure 11A:
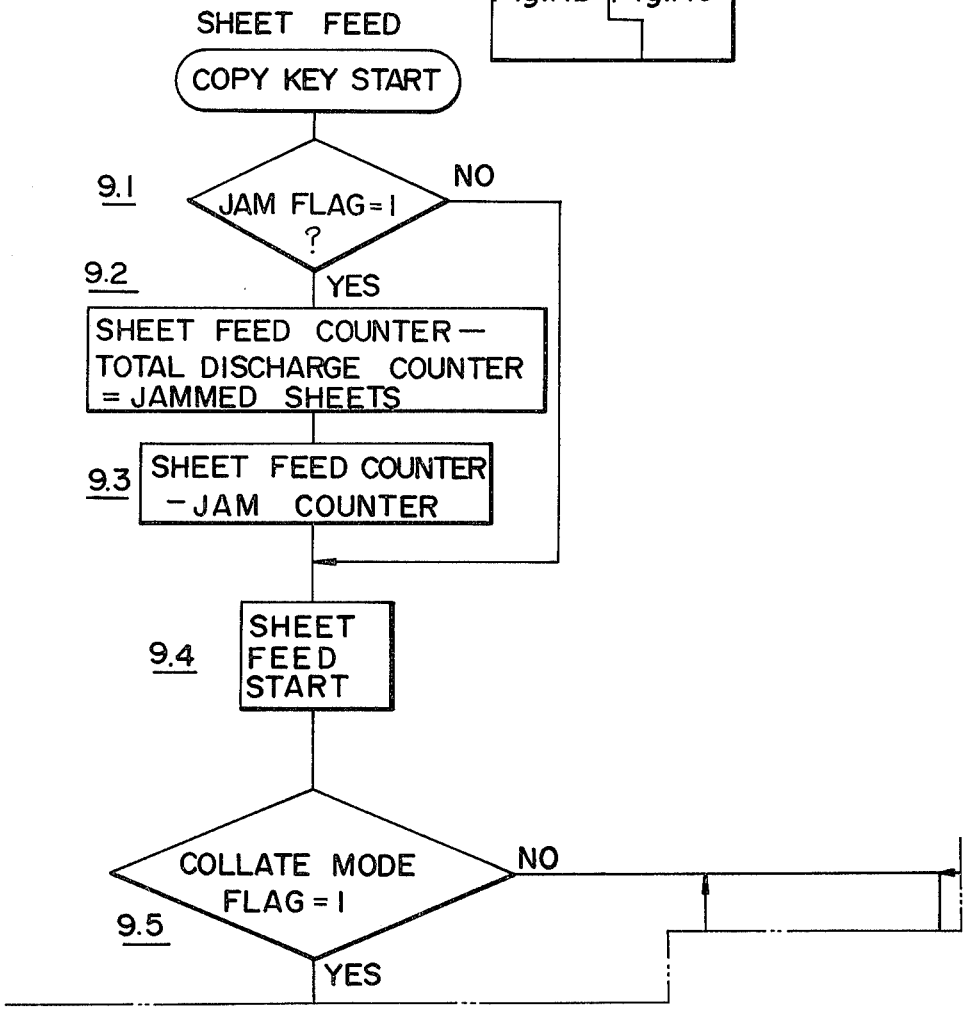
FIGS. 11*a*, 11*b* and 11*c* are combined to constitute a flow chart demonstrating a control method embodying the present invention.
Figure 11B:
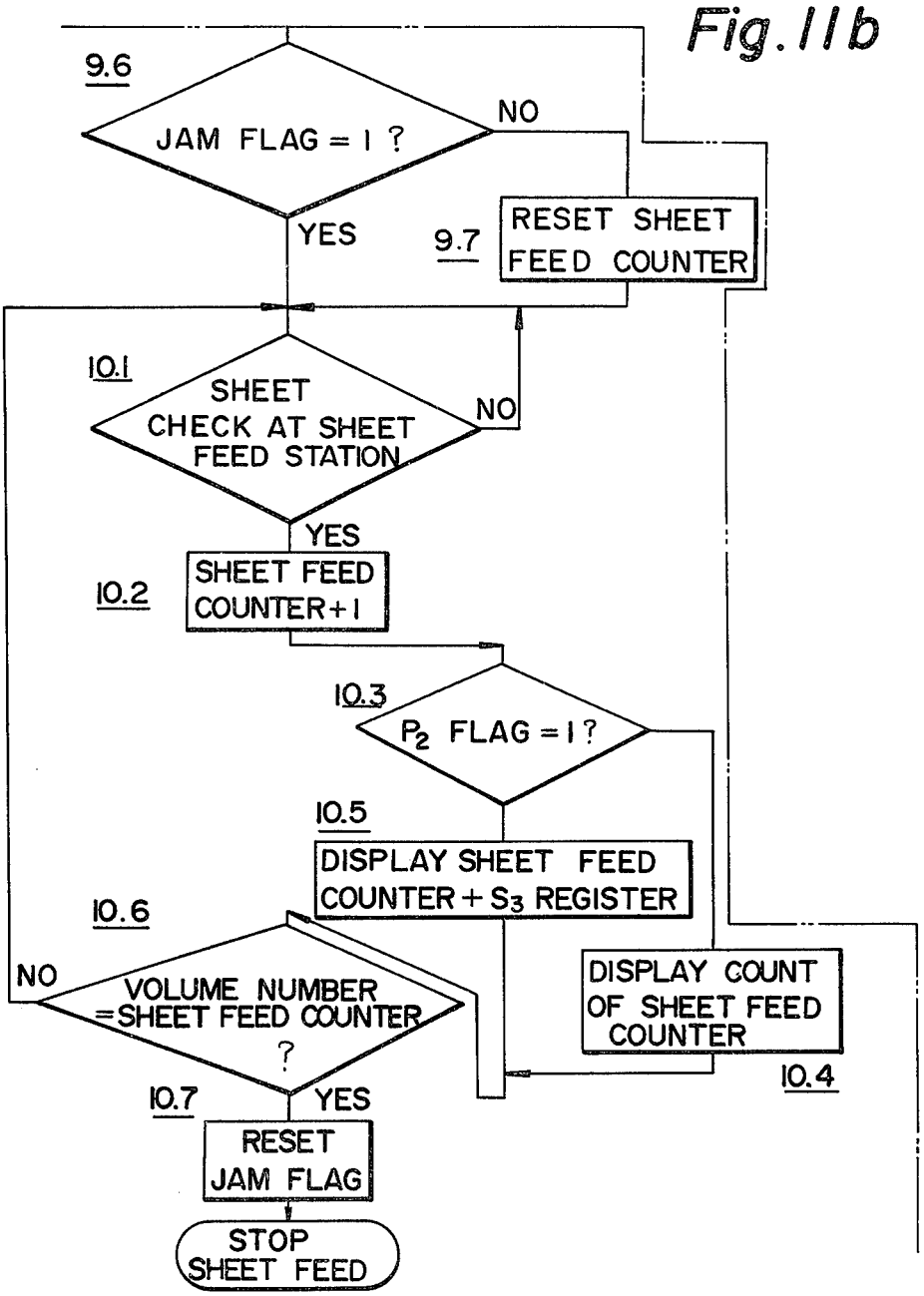
Figure 11C:
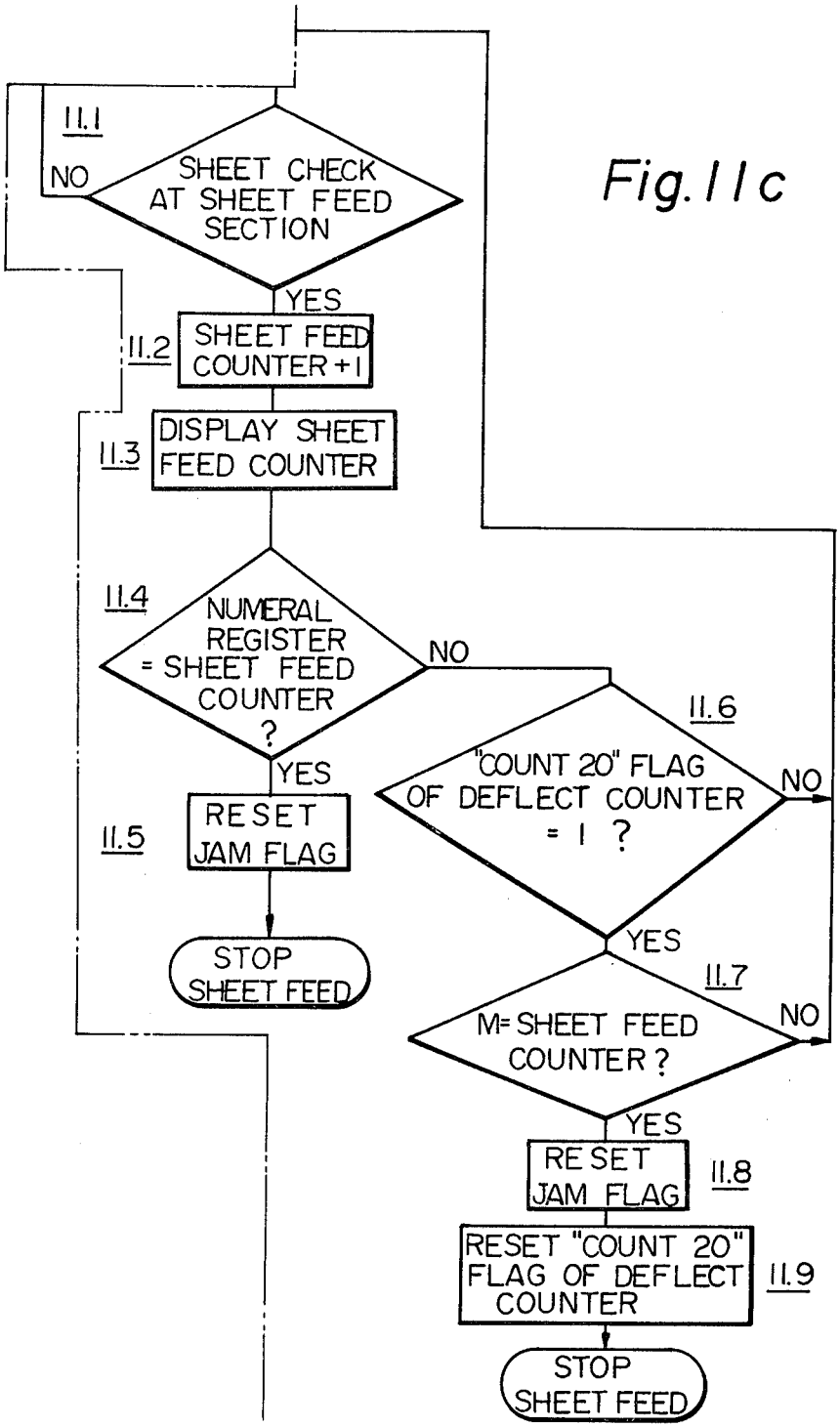

Operation of this control circuit will be described in connection with flow charts shown in FIGS. 11*a* to 11*c*. Let it be supposed for the sake of convenience that each collator is provided with "B" bins where B=20.

As will be described later, a sheet feed counter $C_0$ is associated with the sheet sensor 22 in the sheet feed section of the copying machine 1 to count sheets detected by the sensor 22. As for the collator, a sheet reception counter $C_1$ is associated with the inlet sheet sensor 45 while a discharge counter $C_2$ and a total discharge counter $C_3$ are commonly associated with the sheet sensor 94 in the deflection section. An intermediate sheet detection counter $C_4$ is associated with the intermediate sheet sensor 53. Additionally, a deflection counter $C_5$ is provided to count up every time the deflector 3 moves from one bin to the next, i.e. one module distance.

Operator manipulates either one of the collation mode key 102 and assortment mode key 103 and then specific numeral keys 100. Data inputted through the numeral keys 100 will be the selected number of volumes N (common to the number of copies of the same page) in the collation mode and the total number of copies in the assortment mode.

Figures 1, 9A:
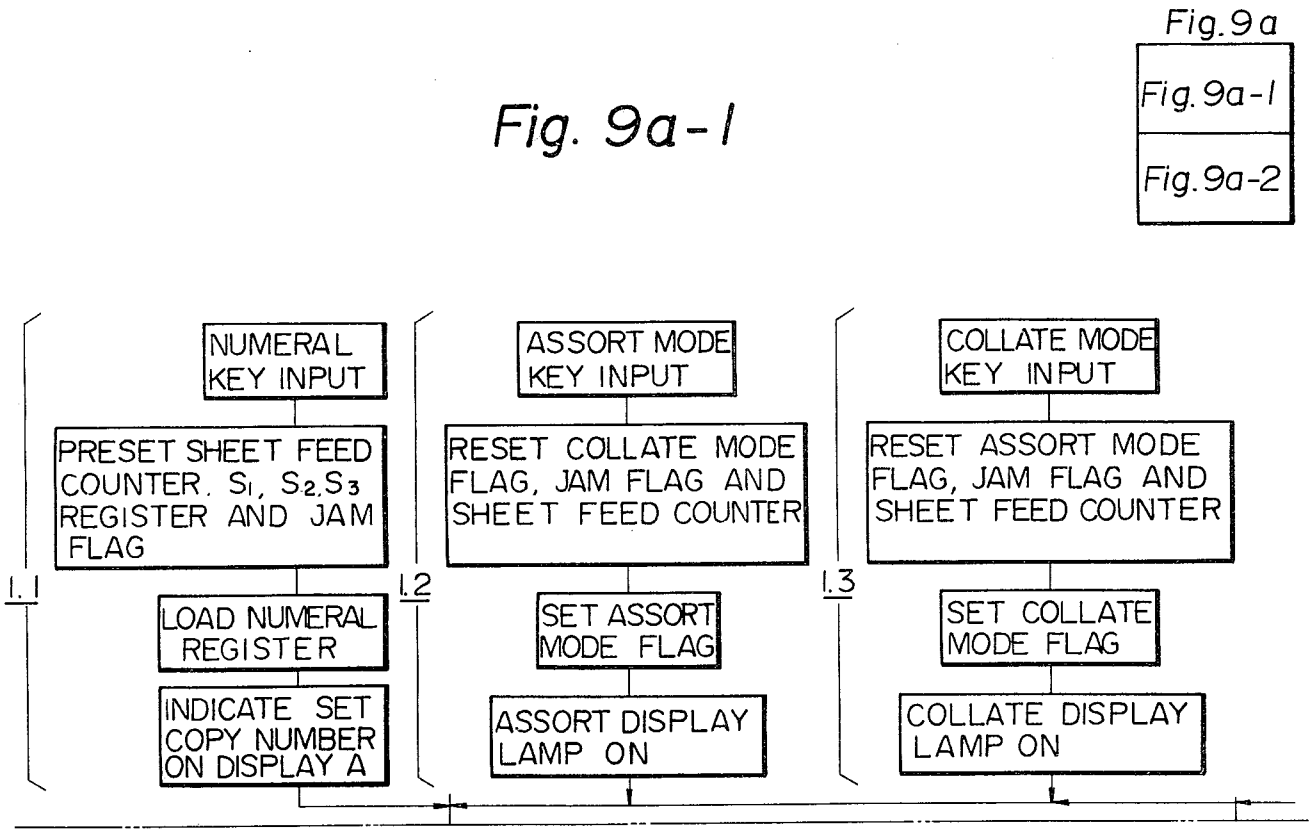
FIG. 9*a* is a diagram illustrating how
Figures 2, 9A:
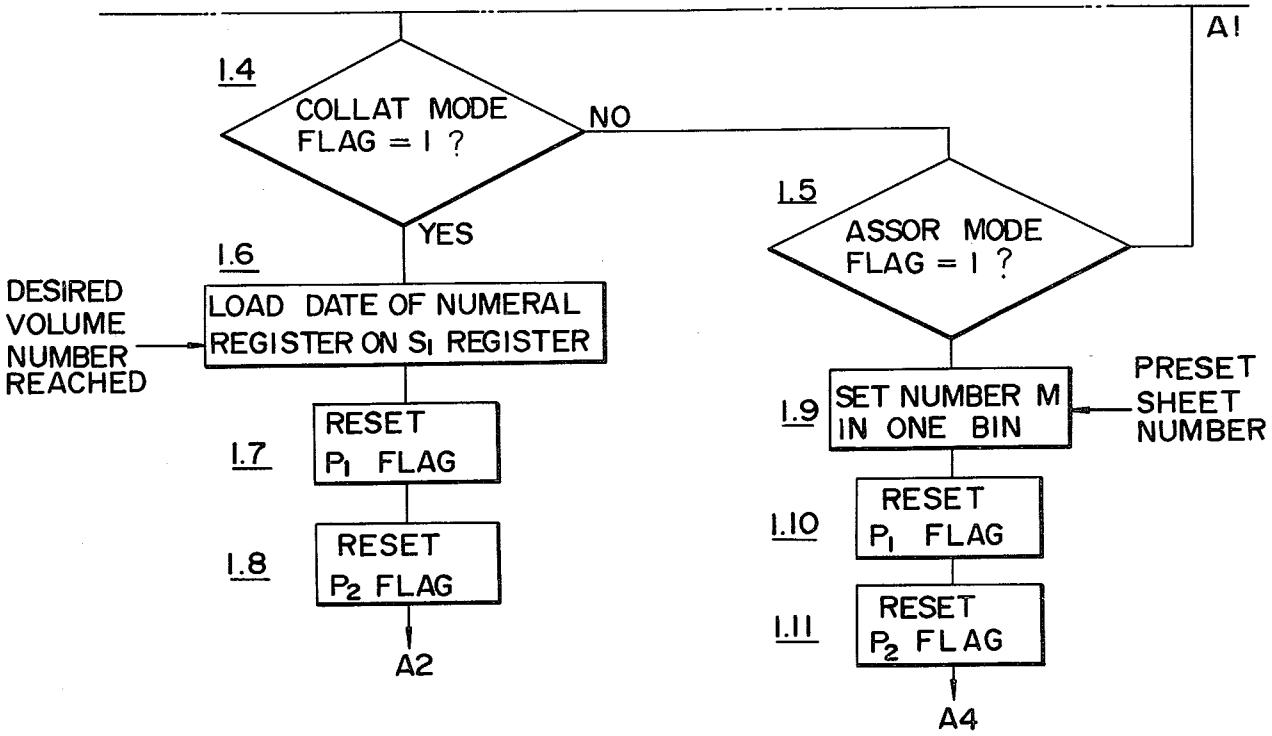
Figures 1, 9B:
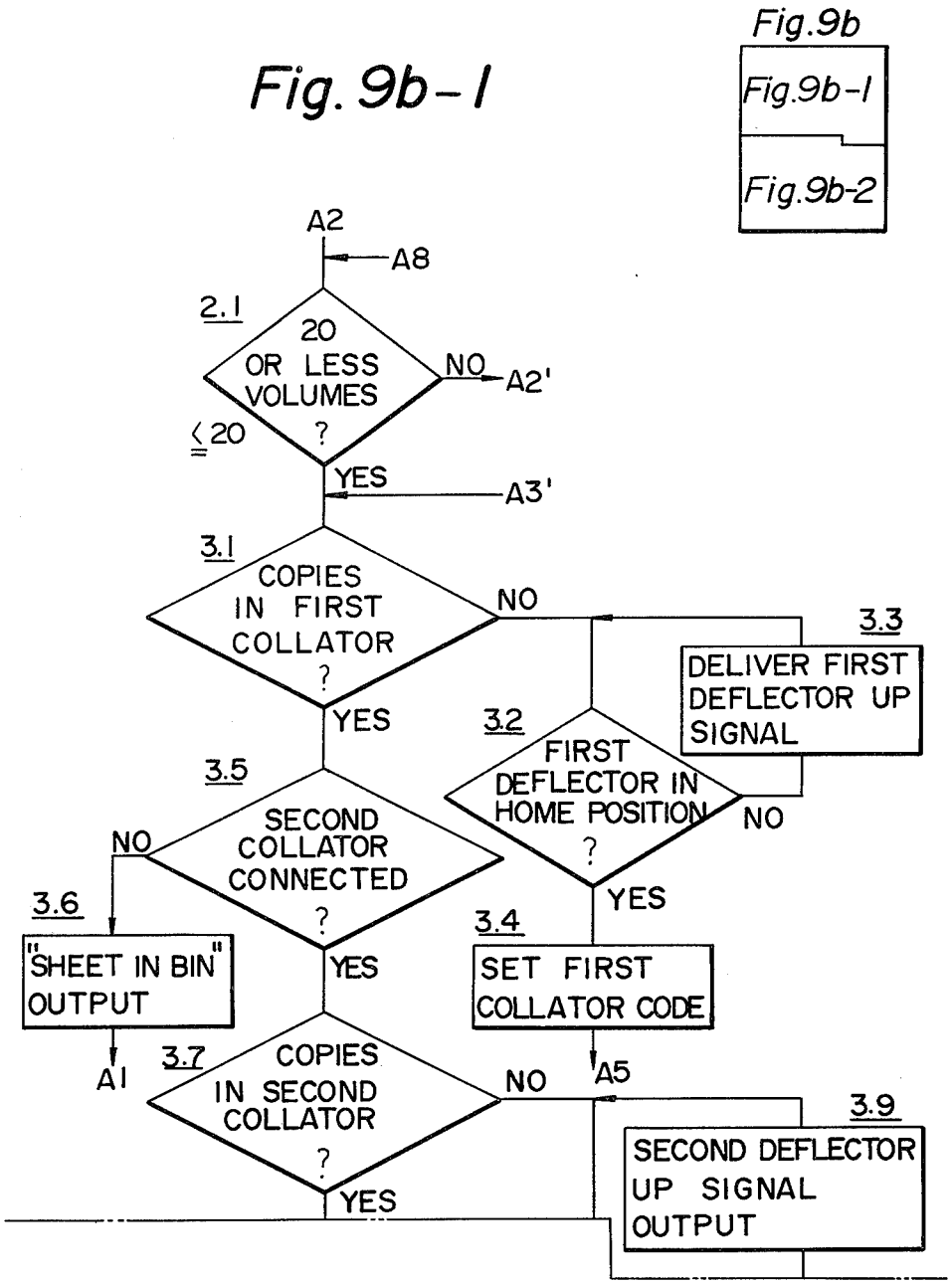
FIG. 9*b* is a diagram illustrating how
Figures 2, 9B:
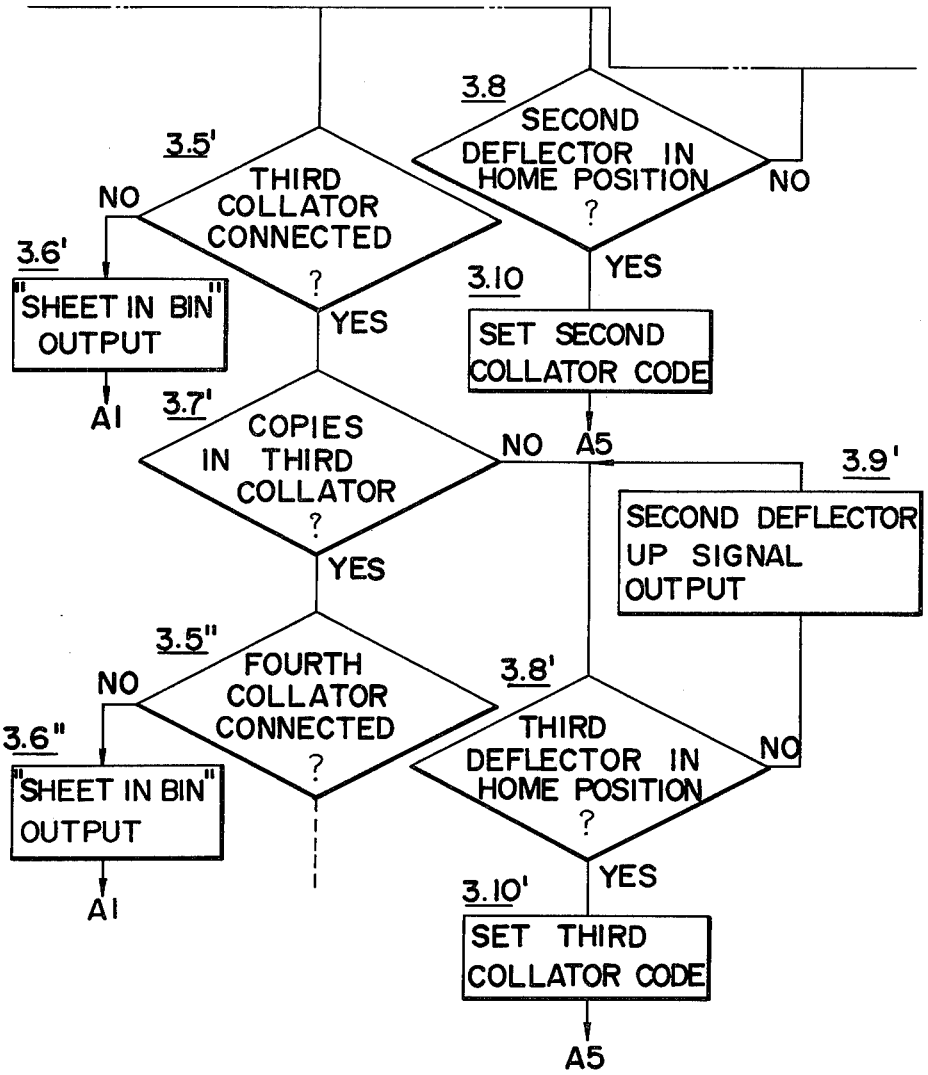
Figures 1, 9C:
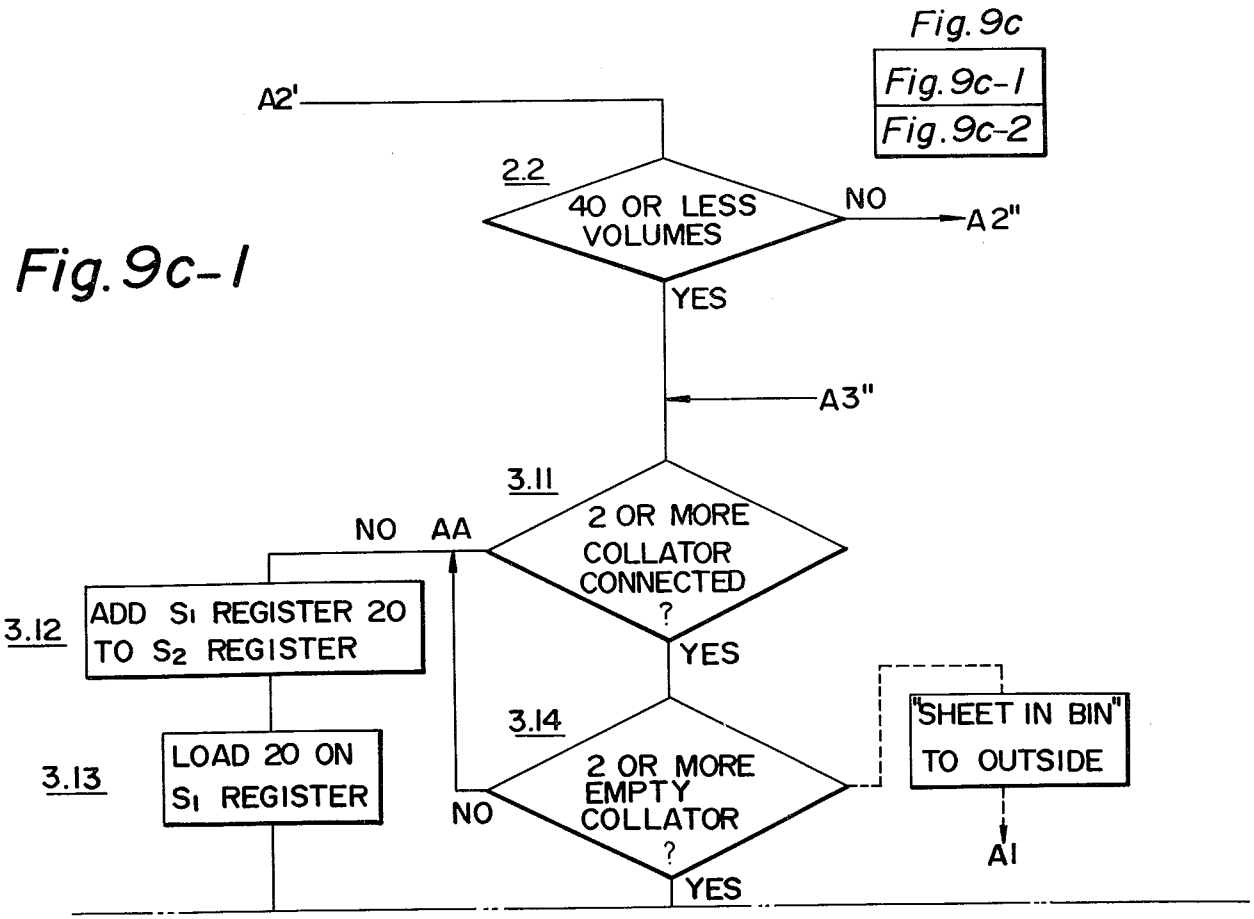
FIG. 9*c* is a diagram illustrating how
Figures 2, 9C:
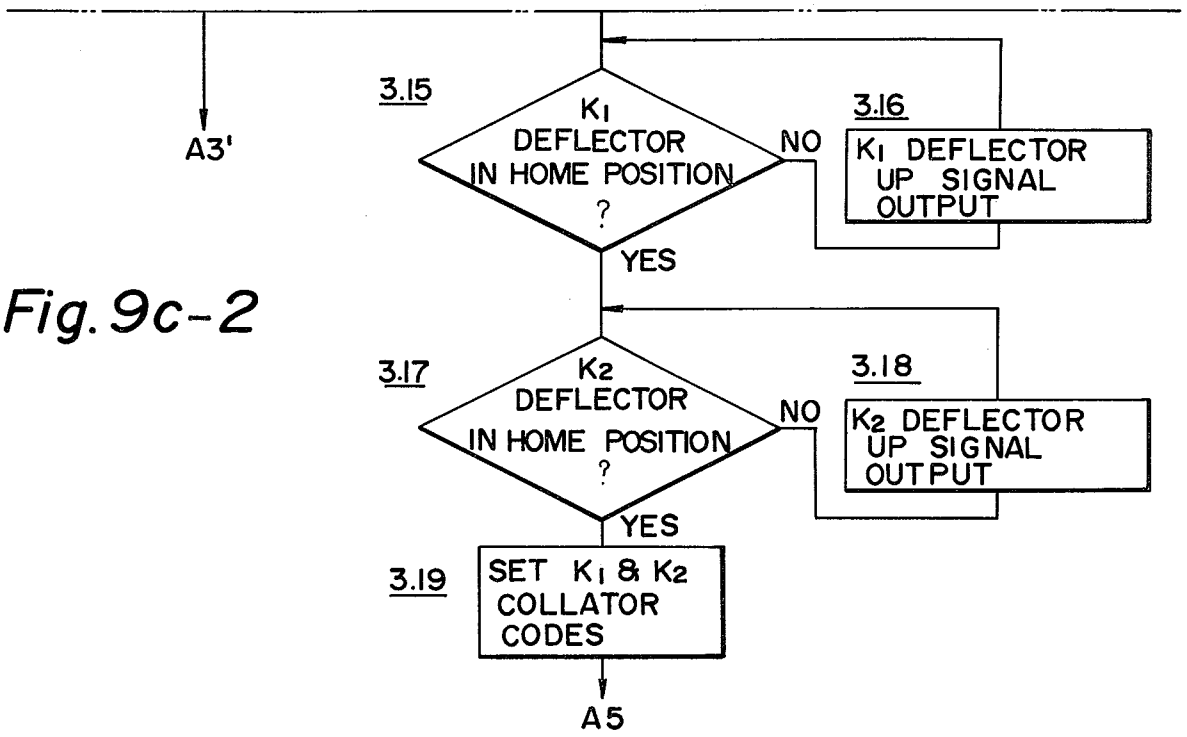

When information is introduced in the control circuit through the numeral keys, the central processing unit CPU resets the sheet feed counter $C_1$ and registers $S_1$, $S_2$ and $S_3$ and a jam flag in step 1.1 of the flow chart shown in FIG. 9*a*-1. Where for example the designated number of volumes N is relatively large and larger than the number of empty bins in the collator connected with the control circuit, the registers $S_1$, $S_2$ and $S_3$ are usable to divide the designated volume number N into processible sub-numbers. The jam flag will be set when jamming occurs in the collator. Next, the central processing unit CPU stores the numerical key input always in a register $S_0$ regardless of the total processing ability BQ of the collator. The data stored in the register $S_0$, which is the numerical input, is displayed as a present copy number on the display A (108) through the display control circuit 204.

When the assortment mode key 103 is depressed, the central processing unit CPU performs step 1.2 wherein a collation mode flag, jam flag and counter $C_1$ are reset and an assortment mode flag is set to turn on the lamp 103'. The collation mode flag and assortment mode flag serve to clearly show that the collation and assortment are to be performed individually. When the collation mode key 102 is depressed on the other hand, the central processing unit CPU performs step 1.3 and resets the assortment flag, jam flag and counter $C_1$, sets the collation mode flag and turns on the lamp 102'.

Since the counter $C_0$ and jam flag are reset by depression of any one of the three different keys 100, 102 and 103, a desired mode of operation can be started merely by manipulating keys necessary for that operation.

Next, the central processing unit CPU determines whether the collation mode flag is "1" and, if not, whether the assortment mode flag is "1" (steps 1.4 and 1.5). The central processing unit CPU starts on the assortment flow in the case of an assortment mode and the collation flow in the case of a collation mode.

In a collation mode, the central processing unit CPU loads the register $S_1$ with the data stored in the register $S_0$ (step 1.6). The content of the register $S_1$ is identical with the desired number of volumes at this stage. Then a $P_1$ flag is reset and then a $P_2$ flag (steps 1.7 and 1.8). The $P_1$ flag is set once a copy sheet is delivered to a bin and will remain set or "1" until the end of the collation or assortment. The $P_2$ flag is set in case where one time of collation cannot complete the desired volumes of collation or assortment.

When the CPU determines the desired mode is assortment at step 1.5, it sets a number of sheets M to be stored in one bin at a time (step 1.9). Naturally, the number M cannot be larger than the maximum accommodatable number of sheets in one bin though discussion on this point will be omitted. Subsequently, the CPU resets the $P_1$ flag and then the $P_2$ flag (steps 1.10 and 1.11) as in the case of collation mode.

Hereinafter will be described how a collator or collators to be used are determined in the collation and assortment modes individually.

In the collation mode, the CPU goes to the steps shown in FIGS. **9*b*-1 and 9*b*-2 as indicated by numeral A2 in FIGS. 9*a*-1, 9*a*-2, 9*b*-1, and 9*b*-2. In view of the relation between the preset volume number N and the total processing ability BQ and effective processing ability Bq, the CPU determines a collator or collators to be used and the processing system, that is, whether to collate sheets by one time of collation or by several times of collation. For this purpose, the CPU first discriminates a range to which the desired number of volumes belongs (steps 2.1, 2.2, 2.3** . . . ).

Where the desired number of volumes is or less than 20 which is the number of bins in a collator, all the copy sheets can be collated if one of the collators K is empty. The central processing unit CPU successively checks the collators K connected in series to find out an empty collator. If any collator is empty, copy sheets will be collated into the empty collator; if not, no collation will occur.

First, the central processing unit CPU designates the first collator $K_1$ and determines whether it is empty by designating the I/O port of the bin sheet sensor 56 (step 3.1). If this collator $K_1$ is empty, the first collator code will be set in an internal register of the central processing unit CPU for indicating the use of this collator (step 3.4). In practice, this is preceded by checking whether the deflector (first deflector) 3 of the collator $K_1$ is in its start position. That is, the central processing unit designates the I/O port of the home position sensor 185 to see whether the first deflector 3 is in the home position (step 3.2). If the deflector is not in the home position, the CPU will designate the I/O port of the elevation drive circuit 175 with its output signal so that the deflector moves back to the home position (step 3.3). As the first deflector regains the home position, the central processing unit CPU sets the first collator code in its register as discussed (step 3.4).

When the central processing unit CPU has determined that the collator $K_1$ is loaded at step 3.1, it checks whether the second collator $K_2$ is present (step 3.5). If the second collator $K_2$ is absent, the central processing unit CPU designates the lamp and turns it on to show "sheet present in bin" (step 3.6), and it returns to the step 1.4 as indicated by numeral A1. If the second collator $K_2$ is present, the central processing unit CPU designates it and then, as in the steps 3.1–3.4 for the first collator, checks whether the second collator is loaded and whether the deflector of this collator (second deflector) is in the home position and sets the second collator code in its internal register. This is followed by a process A5 (steps 3.7–3.10). If the second collator $K_2$ is also loaded, the central processing unit checks whether the third collator $K_3$ is present and performs the same operation as in the case of the second collator (steps 3.5'–3.10'). The same holds true as to the fourth collator $K_4$ and onward if present. In the drawings, the operation is shown up to steps 3.5'' and 3.6'' on the fourth collator $K_4$ with the subsequent steps omitted.

Where the desired number of volumes lies within the range of 21–40, all the copy sheets can be collated without dividing the volume number only if the number Q of collators K is equal to or larger than two and if two of them are empty (q=2). When the empty collator k available is one, copy sheets will be collated by two times of collation with the single collator. At the step 2.1, the CPU has determined whether the desired number of volumes is or less than 20 or larger than 20. If the number is larger than 20, the CPU advances to step 2.2 of FIG. 9(*c*) as indicated by A2' and, there, determines whether it is equal to or smaller than 40.

If the desired number is or smaller than 40, the central processing unit CPU sees whether two or more collators are present by designating the I/O port of each collator (step 3.11). If the number of collators present is less than two, the central processing unit subtracts "20" from the content of the register $S_1$ and adds the difference to the register $S_2$ (step 3.12). The difference mentioned means the remaining number of volumes which will be processed after the first collation of 20 volumes into the first collator $K_1$. The register $S_2$ is then "0" and therefore stores the difference as it is. The central processing unit CPU stores in the register $S_1$ "20" which is the number of volumes to be collated by the first collation (step 3.13). Then the central processing unit CPU, goes to step 3.1 of FIG. **9*b*-1 as indicated by A3'. What occurs in the steps 3.1–3.10'** has already been described. As will be discussed, the first and second collation processes are carried out in succession and the collation completes when the content of the register $S_2$ reaches "0".

When at step 3.11 the central processing unit finds two or more collators available, it designates the collators in succession to see whether two or more of them are empty (step 3.14). If the number of empty collators k is one, the central processing unit CPU returns to the step 3.12 as indicated by AA determining that the copy sheets cannot be collated by one time of collation. If the number of empty collators k is two or more, $q \geqq 2$, it is checked whether the deflector of the first empty collator $k_1$($k_1$ deflector) is in its home position (step 3.15). If not, the central processing unit designates the $k_1$ collator and delivers a $k_1$ deflector elevation signal thereto (step 3.16). After the $k_1$ deflector reaches the home position, the central processing unit sees whether the deflector $k_2$ of the second empty collator $k_2$ is in the home position (step 3.17). If not, a $k_2$ deflector elevation signal is coupled from the CPU to the second empty collator (step 3.18). As the $k_1$ and $k_2$ deflectors both reach the home positions, $k_1$ and $k_2$ collator codes are loaded in the CPU's internal register (step 3.19). Thereupon, the central processing unit CPU starts on a flow A5.

Where the desired number of volumes is within the range of 41–60, all the copy sheets can be collated without dividing them if three or more collators are available and if they include three empty collators k. If two empty collators are present, 40 volumes will be collated first and then the rest with one of them. If the number of empty collators available is one, it will be used three successive times to collate all of the copy sheets. Should the number of connected collators K be less than three, collation would be repeated a plurality of times as in the case stated in connection with two or less empty collators.

When the central processing unit CPU at the step 2.2 determines that the preset number of volumes is or larger than 41, it starts on step 2.3 of FIG. **9*d*-1** as indicated by A2″ and there sees whether the number is or smaller than 60.

If the number is within the range of 41–60, the central processing unit CPU designates the ports of collators to determine whether the available number of collators K is three or more (step 3.20). If not, the central processing unit CPU subtracts "40" from the content of the register $S_1$ and adds the difference, which indicates the number of volumes to be processed last, to the register $S_2$(step 3.12). Next, the number "40" is loaded in the register $S_1$ (step 3.22) and step 3.11 (FIG. **9*c*-1) for the volume number within the range 21–40 is started on as indicated by A3″. Then the central processing unit determines whether the number of empty collators k is two or more (step 3.14). If so, 40 volumes of copy sheets are collated at a time using two empty collators with the contents of the registers $S_1$ and $S_2$ unchanged. However, where only one empty collator is available, "20" is added to the register $S_2$ at step 3.12 and the content of the register $S_1$ is varied from "40" to "20" at step 3.13**; 20 volumes of copy sheets are processed first by one empty collator. The number of the volumes remaining in the register $S_2$ (larger than 20) is thereafter shifted to the register $S_1$.

Where three or more collators were found connected with the copying machine, the central processing unit CPU advances from step 3.20 to step 3.23 and checks whether three or more empty collators are present by designating the I/O ports of their sheet sensors successively. Where the number of empty collators is less than three, the central processing unit goes back to the step 3.21 as indicated by AB. If three or more empty collators exists, the central processing unit CPU sees whether their deflectors $k_1$, $k_2$ and $k_3$ are in the home positions and, if not, brings them back to the same (steps 3.24–3.29). Thereupon, it loads $k_1$, $k_2$ and $k_3$ collator codes in its register (step 3.30). This procedure is common to the steps 3.15–3.19 which have occurred in the case of 21–40 volumes of copy sheets.

Where the desired number of volumes is more than 60, collators to be used and the usage thereof will be determined in the same way as described above; their collator codes will be set and the CPU will start on the flow A5. This is suggested by A2‴ in FIG. **9*d*-1**.

The gist of the above-described system is that, where the preset number of copies is larger than the total processing ability BQ of interconnected collators but if some of the collators are empty, it determines collators to be used so as to collate copy sheets by a plurality of times of collation using the empty collators. As an alternative to this system, when the preset volume number is so large as to exceed the ability BQ, collators to be used may be determined such that copy sheets be processed by multiple times of operation only when all of the interconnected collators are empty.

Figures 1, 9D:
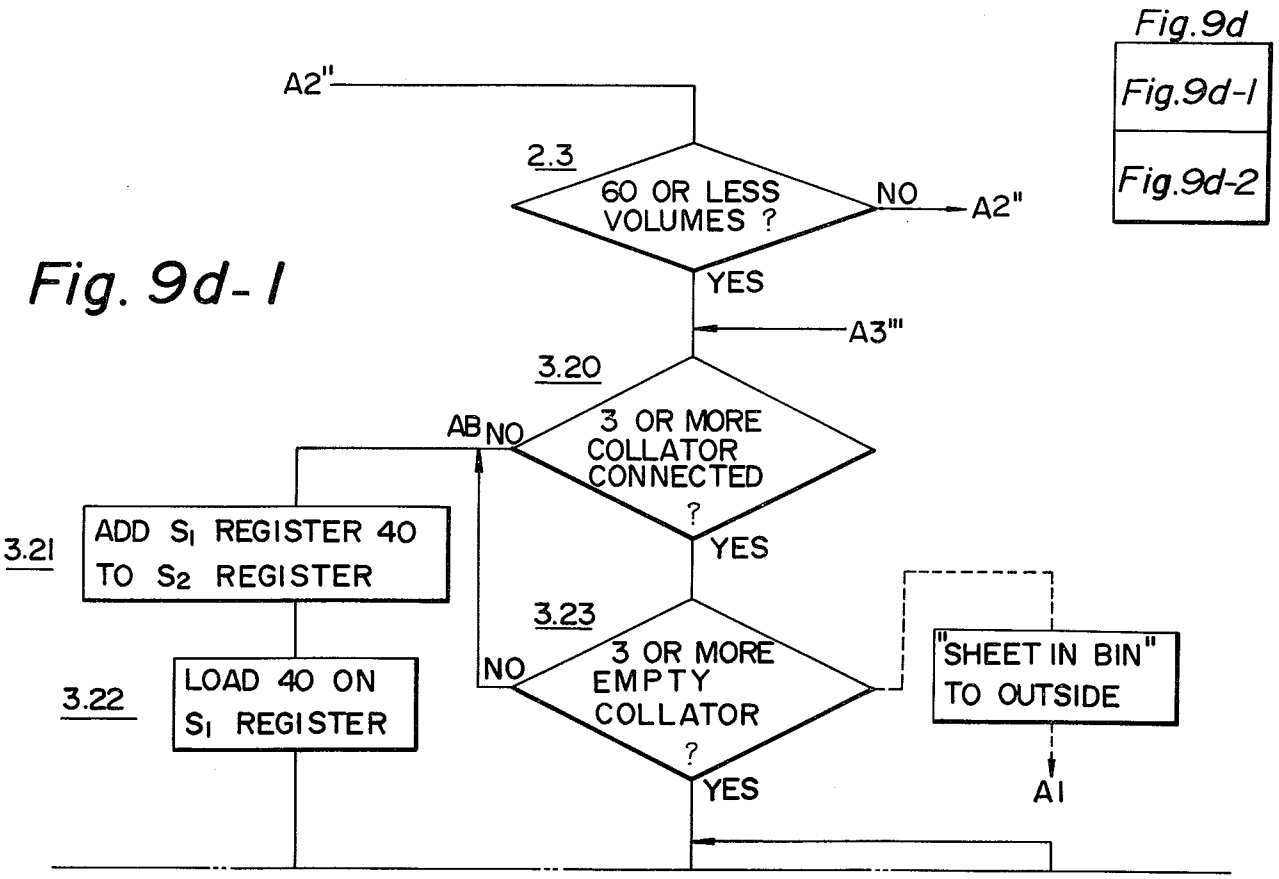
FIG. 9*d* is a diagram illustrating how
Figures 2, 9D:
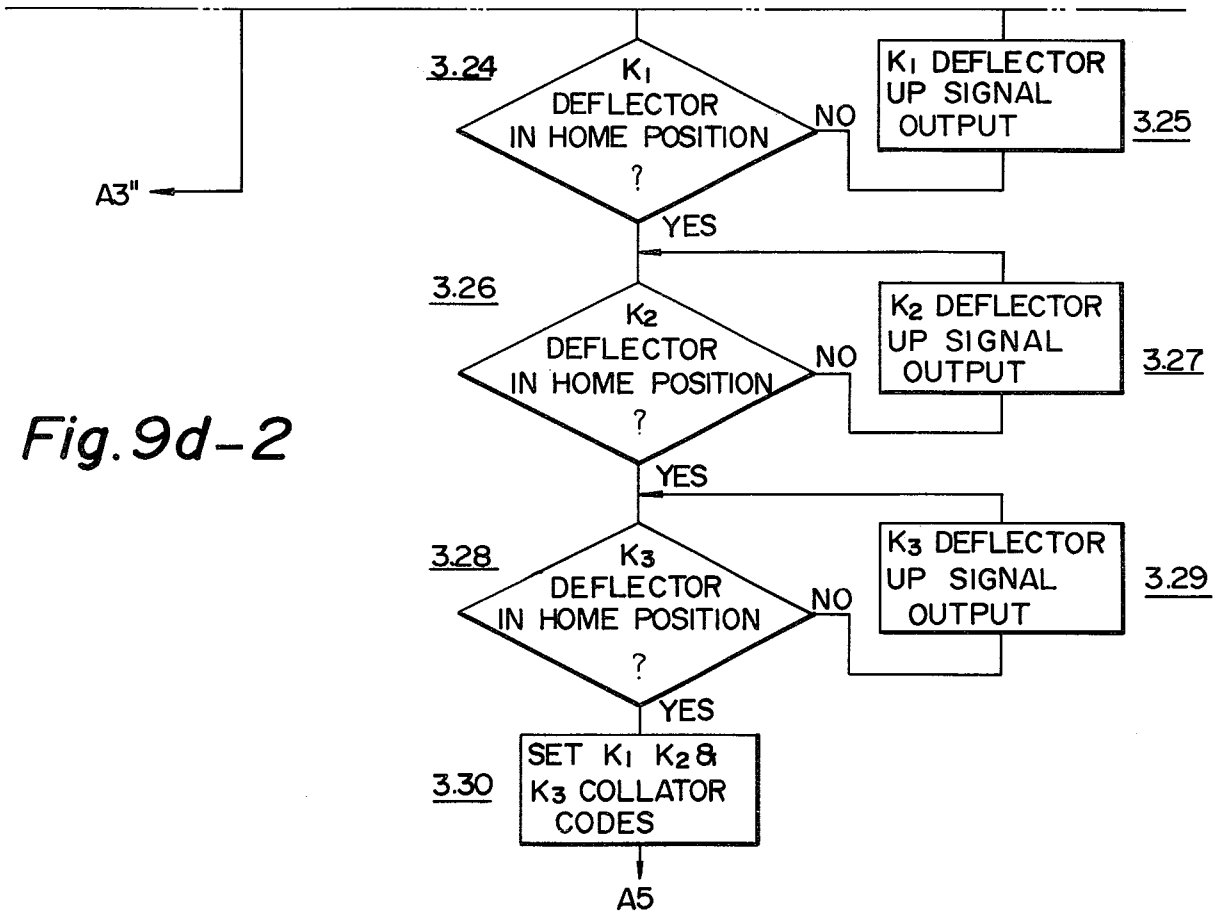
Figures 1, 9E:
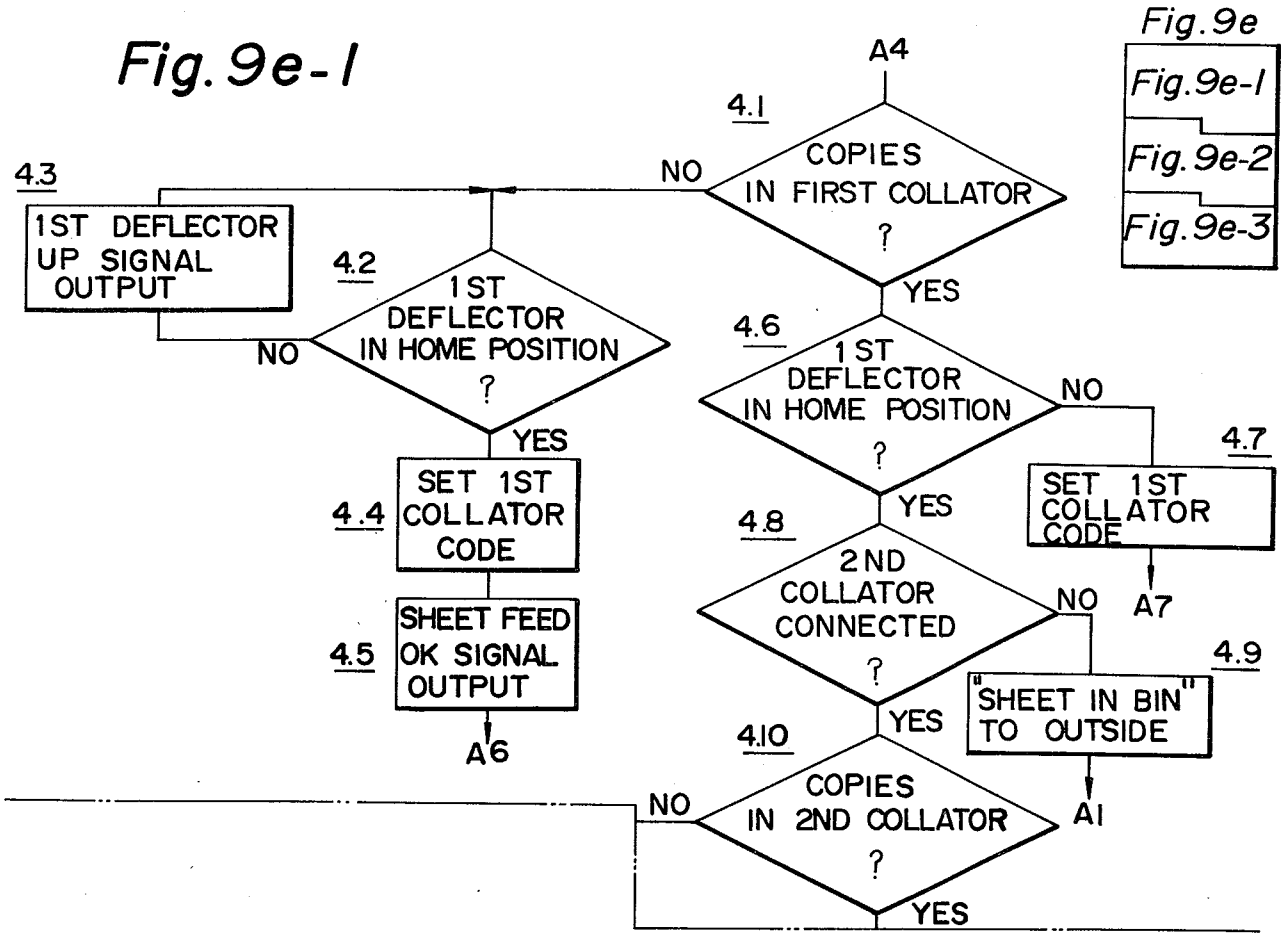
FIG. 9*e* is a diagram illustrating how
Figures 2, 9E:
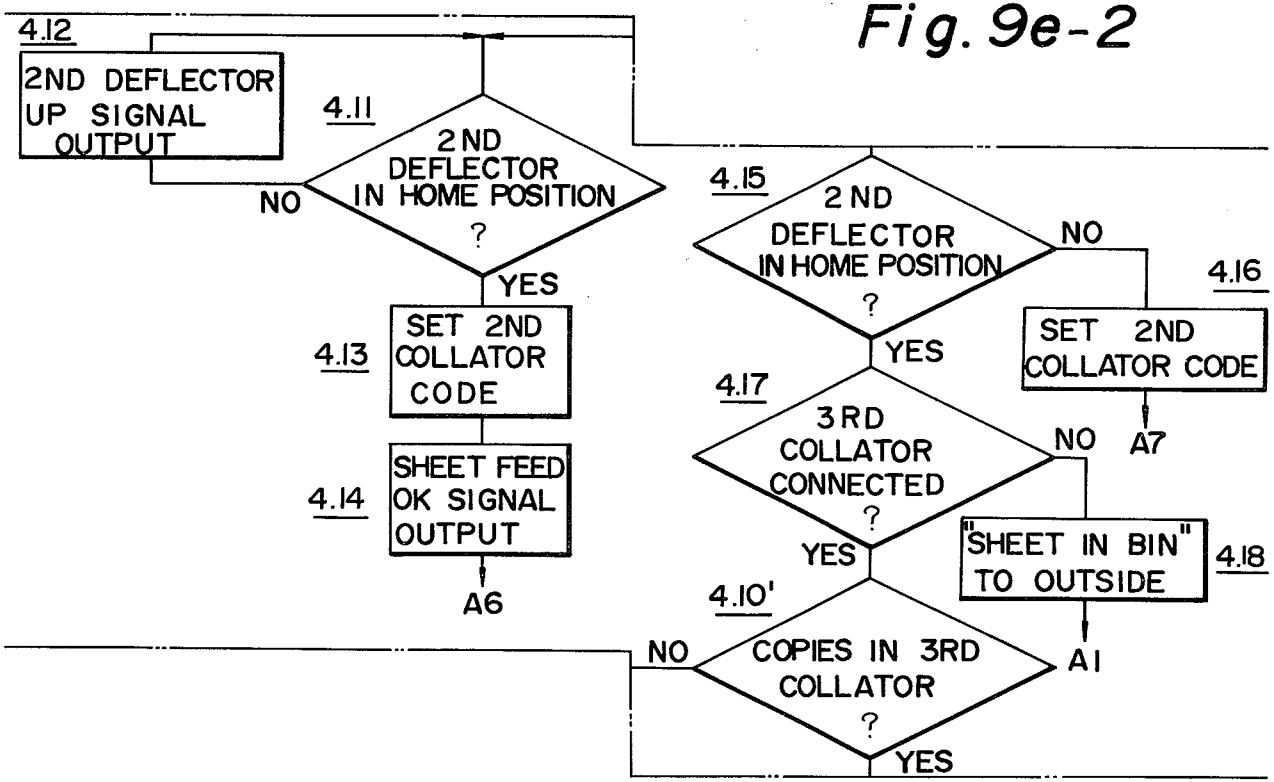
Figures 3, 9E:
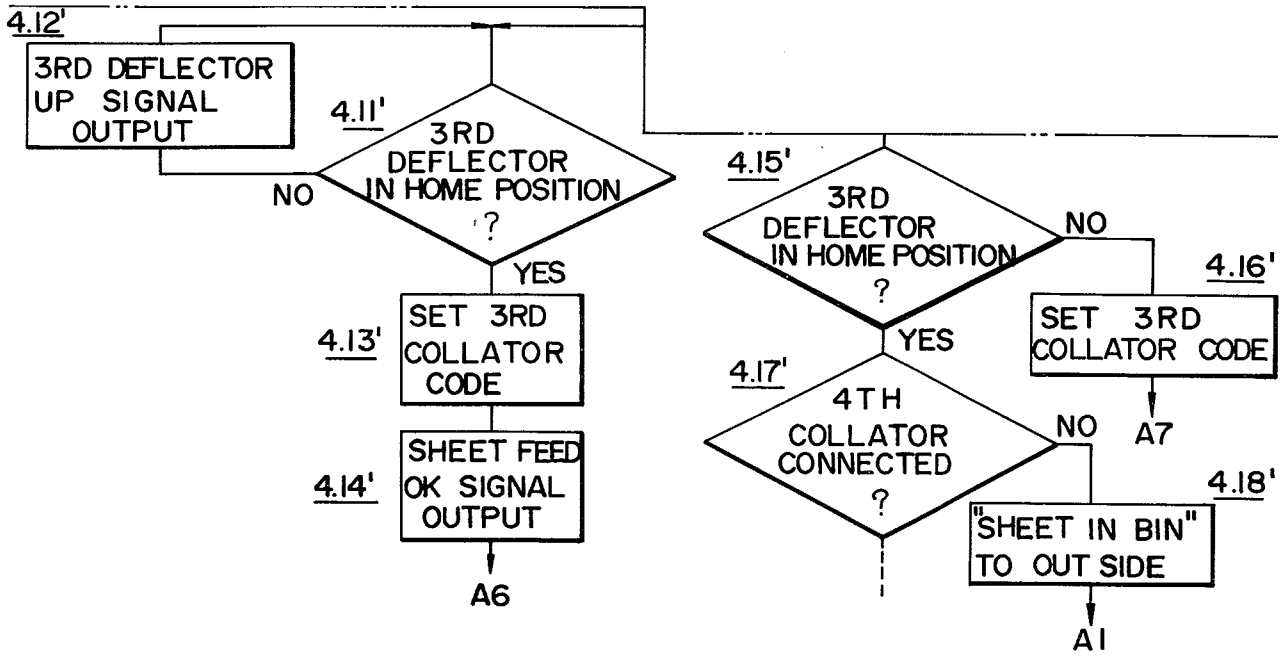
Figures 1, 9F:
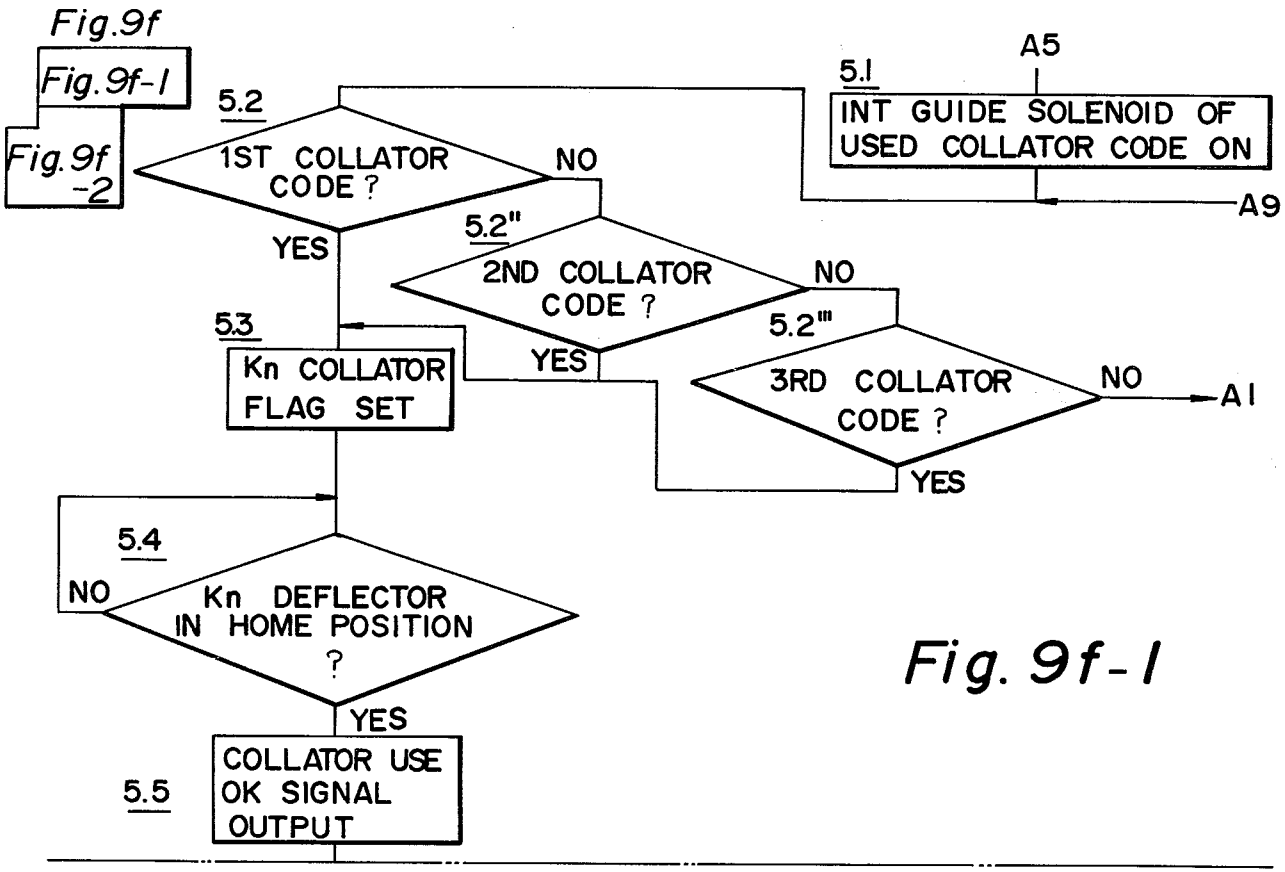
FIG. 9*f* is a diagram illustrating how
Figures 2, 9F:
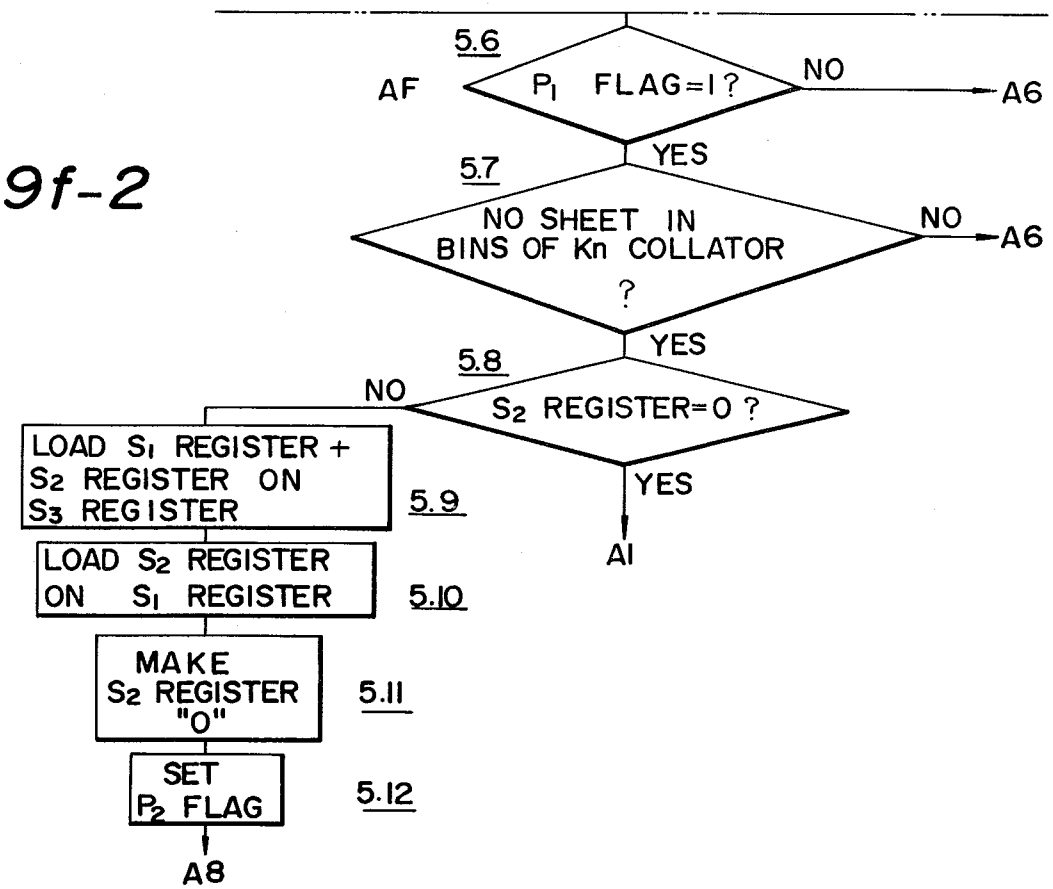
Figures 1, 9G:
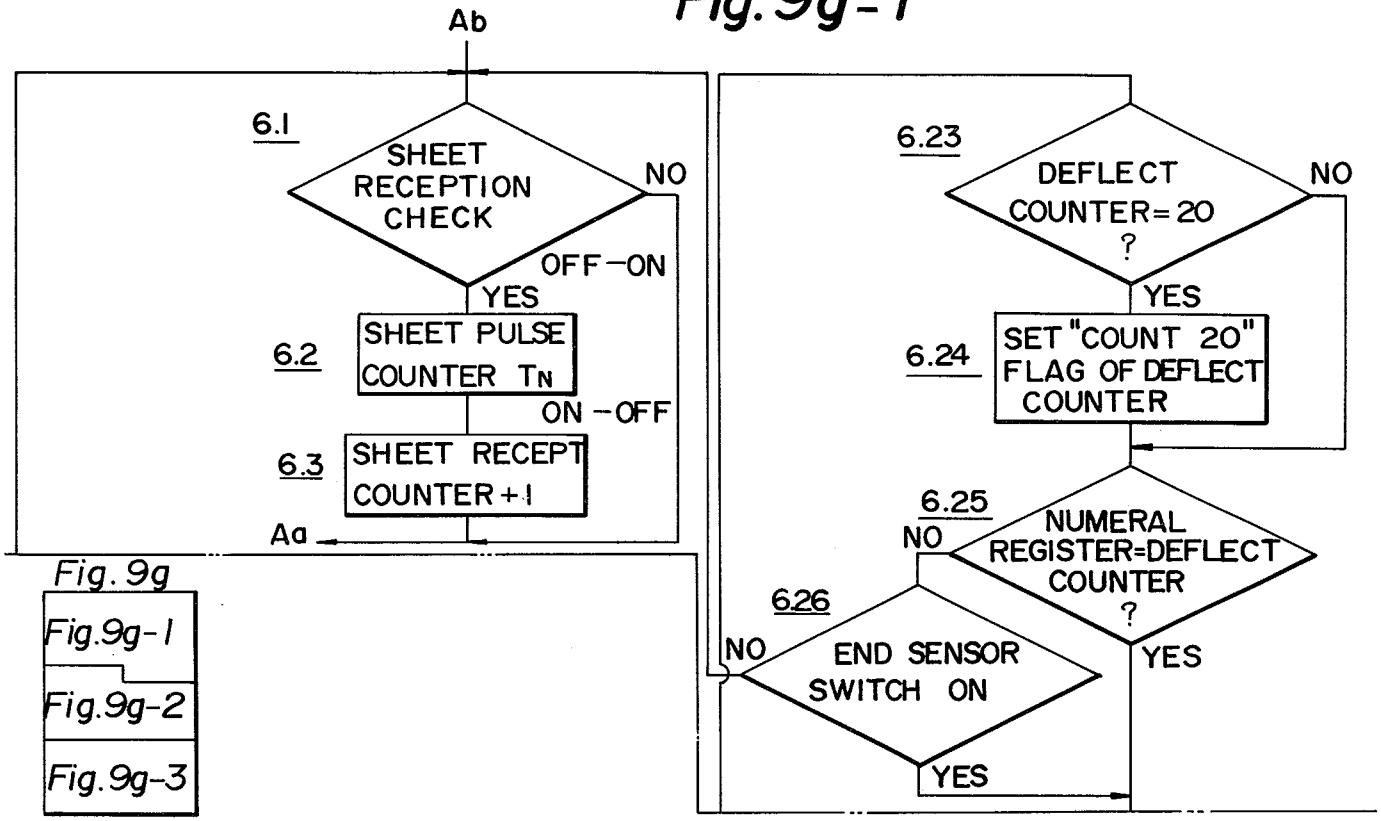
FIG. 9*g* is a diagram illustrating how
Figures 2, 9G:
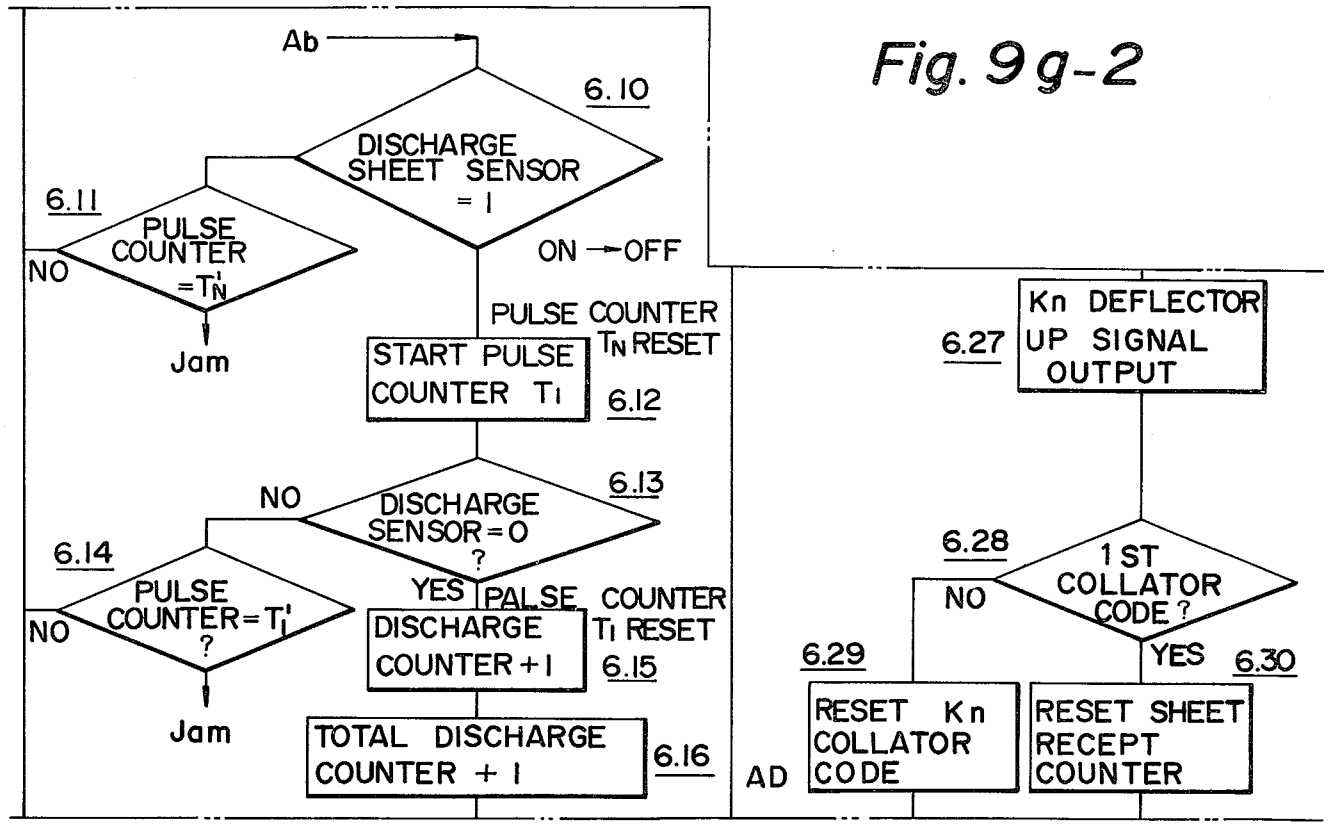
Figures 3, 9G:
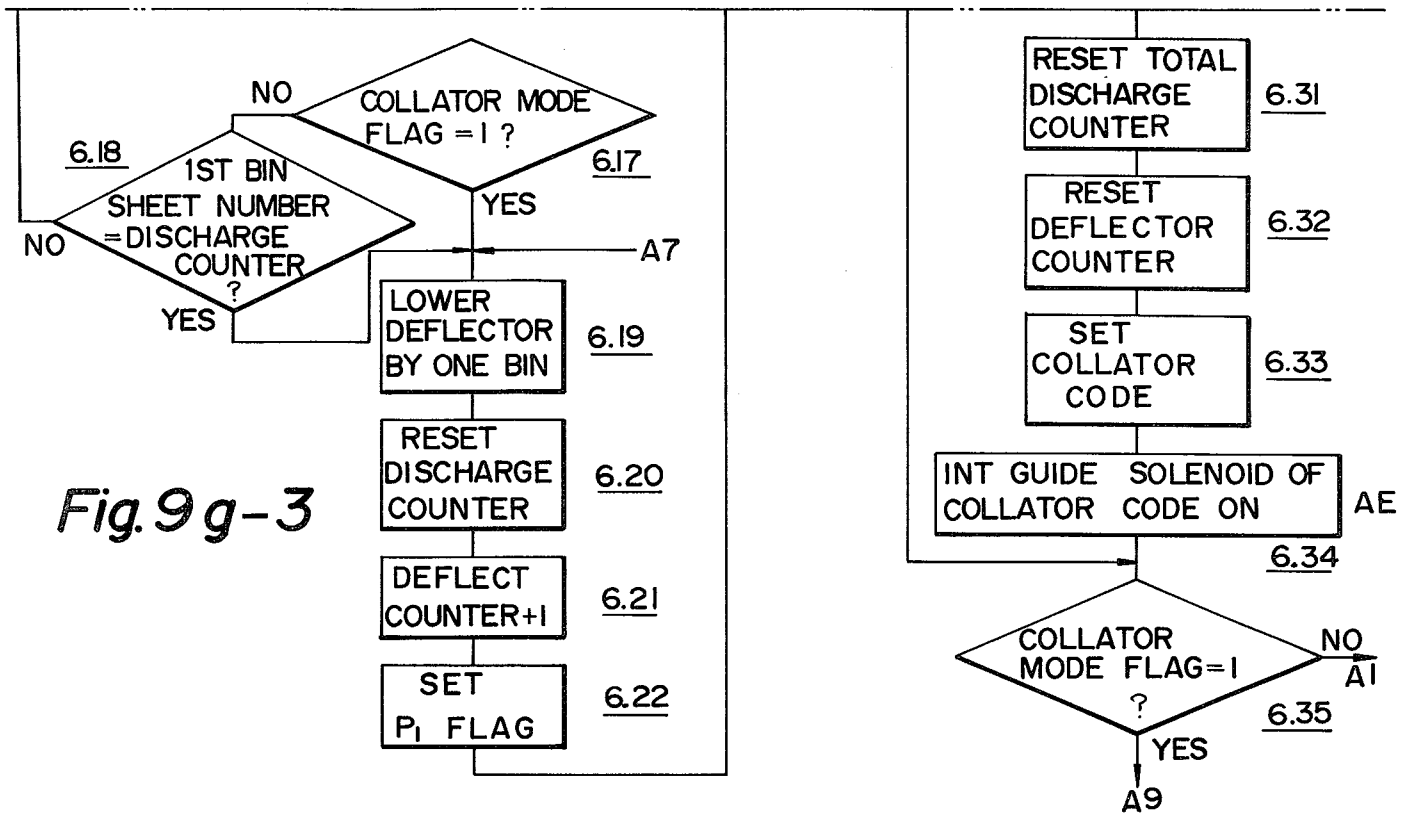
Figure 9H:
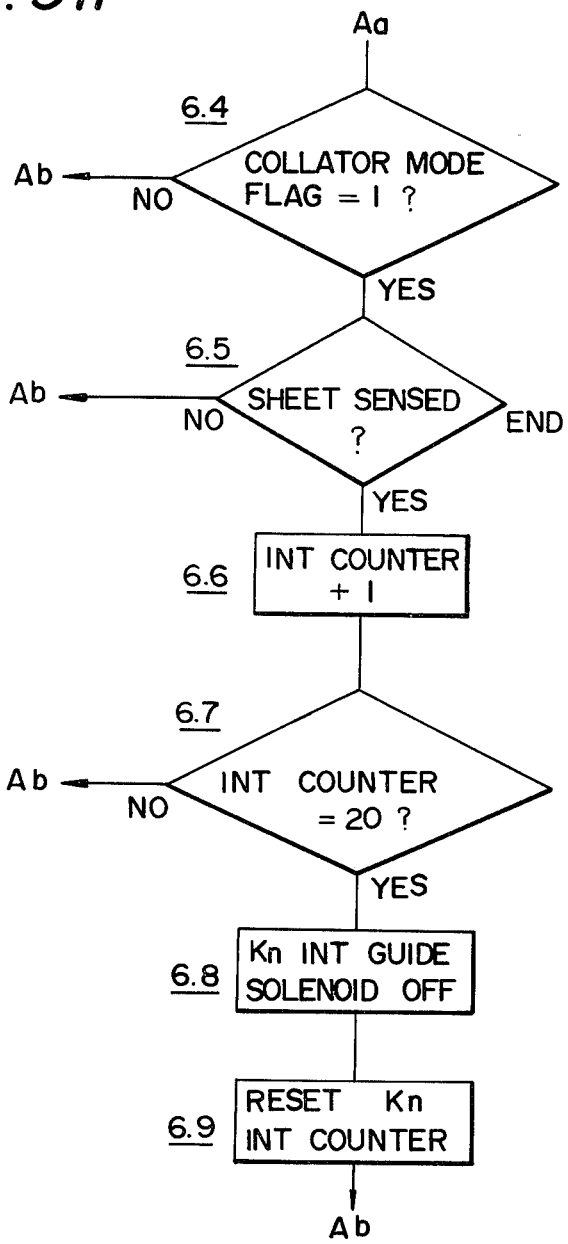
FIGS. 9*h* and 9*i* are flow charts demonstrating a control method embodying the present invention.
Figure 9I:
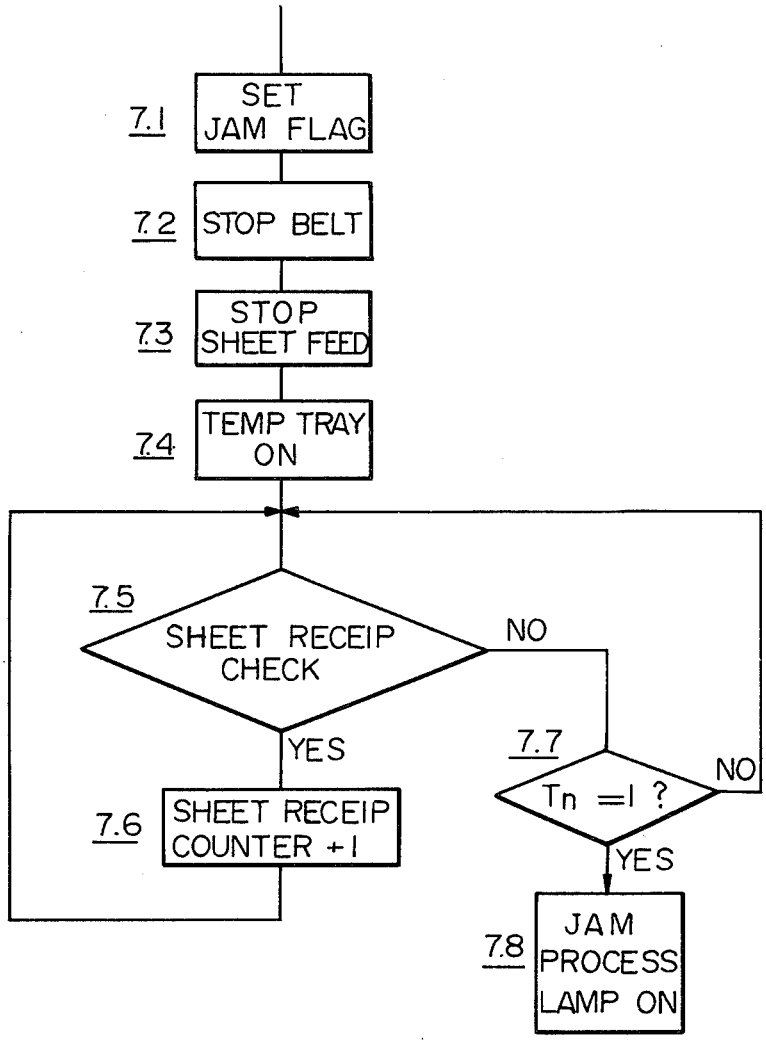

More specifically, when the central processing unit at the step 3.14 of FIG. **9*c*-1 or step 3.23 of FIG. 9*d*-1 cannot find the desired two or more or three or more empty collators, it may produce "sheet in bin" to the outside as indicated by a phantom line instead of returning to the AA or AB. That is, the central processing unit CPU may cause the lamp 106 to display said condition and go back to the step A1** without collation.

Now, when the central processing unit CPU discriminates an assortment mode at the step 1.5 of FIG. **9*a*-1, it sets the number M of copy sheets to be delivered each bin, resets the $P_1$ flag and starts on a flow A4**.

In FIG. **9*e*-1, the central processing unit CPU first checks whether the first collator $K_1$ is empty (step 4.1). If so, it performs the procedure concerning the home position of the deflector of the first collator $K_1$, sets the first collator code, produces a signal permitting the feed of sheets in the copying machine (steps 4.2–4.5),and goes to a A6**.

If the first collator is loaded, the central processing unit CPU determines whether the first deflector is in its home position (step 4.6). Any position of the first deflector other than the home position suggests, that, of the total bins in the first collator, some upper ones had been used for assortment while the others below the position of the deflector are empty. The remaining empty bins can therefore be employed for assortment. The CPU thus sets the first collator code (step 4.7). Presence of the first collator at its home position shows that the first collator has no empty bins at all; the CPU checks whether the second collator is connected with the first (step 4.8). If the second collator is absent, assortment is practically impossible and, therefore, the CPU displays "sheet in bin" through the lamp 106 (step 4.9).

If the second collator is present, the CPU goes through steps similar to the steps 4.1–4.9 to deliver a sheet feed permission signal, to set the second collator code, or to displays "sheet in bin" (steps 4.10–4.18).

When assortment is entirely impossible with the first and second collators, the CPU checks the presence of the third collator and carries out the same actions as described (steps 4.10′–4.18′). This procedure will be repeated in the same way on the other collators.

The system will be operated as follows for practical collation of copy sheets.

As described, the CPU has set the codes of collators to be used and advanced to the flow A5.

In FIG. **9*f*-1, the central processing unit designates the intermediate guide drive circuit 154 of each collator whose codes has been set in the CPU in order to bring its associated intermediate guide plate 54 to the solid line position of FIG. 2 (step 5.1**). Sheets can now be delivered to the first one of the usable collators.

Then the central processing unit CPU determines collators to be actually used by checking the collator codes sequentially from that of the first collator $K_1$ (steps 5.2′, 5.2″, 5.2‴ . . . ). The CPU sets all of the identified collator codes and always sets the $k_n$ collator flag concerned with the leading collator code (step 5.3). Suppose that the first to n-th collator codes are determined in correspondence with the first to n-th bits in the register. Then "101000 . . . " shows that the first and third collator codes have been set whereas the second, fourth and onward collator codes have been reset. In this case, it is the first collator code that has been read out first so that the collator flag on the first collator $K_1$ corresponding to the first collator code is set first. As will be discussed, however, the leading collator code will be reset at the end of the first collation at the corresponding collator except for the case wherein other collator codes are absent; the collator flag of the third collator $K_3$ will be set thereafter. If desired, the central processing unit may provide displays corresponding to the individual collators so as to indicate the operable conditions of the collators simultaneously with setting of their collator flags. Next, the CPU sees whether the $K_n$-th deflector is in the home position by designating the $k_n$ home position sensor circuit 185 (step 5.4). If so, the CPU delivers through the copy start key 104 a signal permitting the feed of copy sheets to the collator concerned (step 5.5). Then the CPU determines whether the $P_1$ flag is "1" (step 5.6).

At the step 1.7 of FIG. 9*a*-2, the $P_1$ flag has been reset and therefore "0". Then the CPU starts on a flow A6 shown in FIG. 9*g*-1. In this flow, the CPU designates the I/O port of the inlet sheet sensor circuit 145 of the collator concerned to check reception of a sheet (step 6.1). As the sheet sensor 45 detects a sheet, the CPU designates the circuit 203 so that a pulse counter TN starts counting output pulses of the encoder pulse generator 199 (step 6.2). Just after the sheet has moved past the sheet sensor 45, the CPU adds "1" to the content of its internal counter $C_1$ (step 6.3).

Next, the CPU deals with switching of collators which may occur during collation of 21 or more volumes of sheets. The CPU for this purpose undergoes the following flows to determine a proper timing for altering the position of the intermediate guide plate 54 in the first empty collator and thereby allow the 21st sheet and onward to be passed to the next empty collator through the first empty collator.

First, as indicated by Aa, the CPU starts on step 6.4 of FIG. 9(*h*) for checking whether the collation mode flag is "1". If not, that is, if the system is in an assortment mode, the CPU needs only to alter the position of the intermediate guide 54 when the deflector reaches the final bin. This is because in the assortment mode some sheets will be delivered continuously into the same bin. In the assortment mode, the CPU goes directly to step 6.10 of FIG. 9*g*-2 as indicated by Ab. If the collation mode flag is "1" indicating a collation mode, the CPU designates the I/O port of the intermediate sheet sensor circuit 153 to detect a sheet (step 6.5). If the intermediate sheet sensor 53 does not sense a sheet, the CPU advances to a flow Ab; if the sheet sensor has detected a sheet, the CPU adds "1" to its counter $C_4$ (step 6.6). Thereafter, the CPU judges whether the content of the counter $C_4$ has reached "20" (step 6.7). If not, the CPU goes to the flow Ab. If so, the CPU designates the I/O port of the intermediate guide drive 154 to produce a solenoid OFF signal (step 6.8). Then resetting the counter (step 6.9) $C_4$, the CPU advances to the flow Ab. In this way, the intermediate guide 54 will be re-positioned at a proper timing when the collation has proceeded to the 20th bin of the collator.

At step 6.10 of FIG. 9(*g*), the CPU designates the I/O port of the discharge sheet sensor circuit 194 to check the discharge of the sheet. If the sheet sensor 94 does not detect the sheet, the CPU designates the circuit 203 and refers to the content of the pulse counter TN activated at the step 6.2 (step 6.11). When the sheet sensor 94 does not detect the sheet even after the pulse counter has reached a count T'N which corresponds to the time period which a sheet takes to travel from the sheet sensor 45 to the sheet sensor 94, the CPU determines that jamming has occurred in the intersensor passage and starts on a jam flow of FIG. 9(*i*) as indicated by Jam.

Until the counter TN reaches the count T'N, the CPU returns to the step 6.1 to prepare for checking of the next sheet. If the sheet sensor 94 at the deflector safely detects the sheet, the CPU resets the pulse counter TN. Then the CPU designates the circuit 203 and activates a pulse counter $T_1$ to examine jamming in the neighborhood of the deflecting section (step 6.12). The CPU then sees whether the sheet has safely moved past the sheet sensor 94; if so, the sheet sensor 94 would no longer detect the sheet (step 6.12). Up to the instant the pulse counter $T_1$ reaches a count $T'_1$ which corresponds to the time period necessary for one sheet to move clear of the sheet sensor 94, the CPU returns to the step 6.1 and prepares for checking of the next sheet. If the sheet sensor 94 keeps on detecting the sheet even after the counter $T'_1$, the CPU judges this condition as jamming and advances to the jam flow of FIG. 9(*i*) (step 6.14).

At the instant the sheet sensor 94 stops sensing the sheet, the sheet will have been safely delivered into a bin. Hence, the CPU resets the pulse counter $T_1$ and adds "1" to the content of the discharge counter $C_2$ and also adds "1" to the content of the total discharge counter $C_3$ (steps 6.15 and 6.16). Next, the CPU sees whether the collation mode flag is "1" (step 6.17). In a collation mode, the collation mode flag will naturally be "1" and the CPU goes to step 6.19 and, there, designates the I/O port of the loweration drive 180 to deliver a signal for lowering the deflector one module distance down to the next bin. This causes the deflector move downward to the next bin. The CPU resets the discharge counter $C_2$ and adds "1" to the deflection counter $C_5$ (steps 6.20 and 6.21). In short, in a collation mode, the discharge counter $C_2$ is reset just after counting "1" while the deflection counter $C_5$ increases its count one by one every time the deflector 3 lowers one module distance to the next bin. The counter $C_5$ is designed such that its count is "1" at first, "20" when the lowering deflector has reached the 20th bin, and "1" when the deflector has returned to the home position to engage the end sensor 86. With the sheet stored in the initial bin, the CPU sets the $P_1$ flag to clearly show that collation is under way (step 6.22).

Subsequently, the CPU checks whether the count of the counter $C_5$ is "20" (step 6.23). If so, the CPU sets a flag of "count 20" (step 6.24). Since at this stage of description the deflector 3 has just shifted to the second bin, the CPU advances from step 6.23 to step 6.25 and sees whether the content of the counter $C_5$ is identical with that of the numeral register. This numeral register usually stores a preset number of volumes N or a preset total number of sheets to be assorted. If the two counts are identical, the "N" volumes of sheets on the first page ("N" bins) will have been fully collated if in the collation mode or the total preset number of sheets will have been fully assorted if in the assortment mode. Thus, the CPU at this instant produces a $K_n$ deflector elevation signal (step 6.27). However, as long as the content of the counter $C_5$ does not coincide with that of the numeral register, the CPU designates the I/O port of the end sensor circuit 186 to determine whether the deflector 3 is in the position of the end sensor 86 (step 6.26). If not, that is, if the sheet delivery in the collator concerned is still under way, the CPU goes back to the flow A6 and continues the collation or assortment. Arrival of the deflector at the position of the end sensor means that assortment or the first collation has completed in the collator. Then the CPU produces a $k_n$ deflection elevation signal to bring the deflector 3 back to the home position (step 6.27).

The CPU determines whether the collator code set is only one (step 6.28). The number of collator codes set in advance will sometimes be one and sometimes two or more.

If the CPU finds two or more collator codes, it resets the collator code of the collator having been used and replaces it with the next collator code and advances to step 6.35 (step 6.29). Concerning the previously mentioned example, the code "101000 . . . " changes into a new code "001000 . . . ". Then the CPU checks whether the collation mode flag is "1" (step 6.35) and, if so, returns to the step 5.2' of FIG. **9*f*-1 as indicated by A9 so as to enter collation using the next empty collator $k_2$ (collation code "001000 . . . "). Thus, collation on the same page occurs in the next empty collator $k_2$ Such operation is repeated to sequentially reset the collator codes. At the end of collation in the last empty collator, the CPU determines "collator code is one" at the step 6.28. The same holds true, in the assortment mode except that the CPU advances from the step 6.35 to the step 1.4 of FIG. 9*a*-2 as indicated by 1**.

One collator code either found from the start or finally reached shows the end of assortment or that of one collation or a midway interval thereof. More specifically, where the preset number of volumes to be collated or sorted is larger than the effective processing ability of empty collators, sheets must be removed from bins to produce an empty collator; if the intended number of volumes is within the effective processing ability, the one collator code indicates the end of assortment or the first collation. The CPU thus goes from the step 6.28 to step 6.30 when determined that one collator is present, resetting the sheet counter $C_1$. Also, the CPU resets the total discharge counter $C_3$ and deflection counter $C_5$ to set the whole collator codes "101000 . . . " are set (steps 6.31–6.33). Thereafter, the CPU designates the I/O ports of the intermediate guide drives 154 corresponding to the preset collator codes to cause them to produce solenoid drive signals and then advances to step 6.35 (step 6.34).

At the step 6.35, the CPU checks whether the collation mode flag is "1" and, if so, it returns to the step 5.2' of FIG. **9*f*-1 as indicated by A9 so as to start on the second collation. If the system is in the assortment mode, the CPU returns to the step 1.4 of FIG. 9*a*-2 as indicated by A1**.

The system now reaches the end of assortment or the first collation or an interval thereof. At this instant, the $P_1$ flag has been made "1" and, in the case of collation made, shows that collation is under way. As the $P_1$ flag becomes "1", the CPU determines whether the bins of the collator having been used are loaded with sheets (step 5.7). Presence of sheets in this case precisely shows that collation is under way. This is the state which permits the second collation to occur after the first collation. Accordingly, the CPU returns to the flow A6 and repeates the series of actions described above (steps 6.1–6.35) on the next page. Then the deflector is indexed downward delivering sheets one by one into the successive bins. Until the content of the deflection counter $C_5$ coincides with that of the numeral register, the deflector will return to the home position every time it actuates the end sensor 86 and thus repeatedly collate sheets on the various pages. Collation at this collator will be completed at the instant the operator concludes that copying cycles on all of the desired number of pages have finished and stops the copying operation of the machine. It follows that, even though all of the interconnected collators might have been empty at the start of collation, bins in at least one of the empty collators k must be emptied if the desired number of volumes is larger than the total number of bins of the entire empty bins k.

Suppose that the operator has removed sheets from bins of any one of the collators. Then the CPU at step 5.7 determines "the $k_n$-th collator is empty". At this time, the CPU sees whether the desired number of volumes have been obtained and, if not, it will decide how many volumes must be additionally collated.

First, the CPU checks whether the content of the register $S_2$ is "0" to see whether the desired number of volumes have been collated (step 5.8). If the content of the $S_2$ register is "0", the CPU returns to the flow A1 since it suggests that the expected volumes have been obtained. But if not "0", the CPU prepares for the collation of the remaining volumes by adding the contents of the registers $S_1$ and $S_2$ together and storing the sum in the register $S_3$ (step 5.9). Then the CPU shifts the data in the register $S_2$ to the register $S_1$ to make the register $S_2$ "0" (steps 5.10 and 5.11). The CPU sets the $P_2$ flag to clearly show that collation is under way and returns to the flow A8 collate the remaining volumes. The content of the register $S_3$ is "0" at the first collation but, from the second and onward, the content of the register $S_1$ is added to it.

Now, actual procedures for assortment will be discussed hereinafter.

When the CPU finds out a completely empty collator and sets the collator code through the step 4.4, 4.13, 4.13' . . . of FIG. **9*e*-2, it goes to the aforementioned flow A6. Jamming is checked throughout the path to the discharge sensor 94 on the deflector and in the neighborhood of the discharge sensor 94 while the counters $C_2$ and $C_3$ increase their counts for each sheet (steps 6.1–6.16). This has already been stated in conjunction with the collation mode. At step 6.17, the CPU determines whether the collation mode flag is "1". Since it is not "1", the CPU advances to step 6.18 and there checks whether the content of the counter $C_2$ is identical with the number M to be stored in one bin. If not, the CPU returns to the step 6.1 and repeates the above procedure. As the present number M of sheets are stored in a common bin, the CPU advances to step 6.19 to lower the deflector 3** one module distance to the next bin.

On the other hand, when the CPU finds out a collator having some empty bins therein, it sets the collator code in the step 4.7, 4.16, 4.16' . . . and goes to step 6.19 of the flow A6 indicated by A7 so that the deflector is lowered immediately by one module distance. Sheets will then be assorted into the empty bin just below the lowest loaded bin.

After the deflector has lowered one module distance, the CPU performs the operation discussed in connection with the collation mode. As sheets are fully delivered into the 20th bin of the collator, the CPU returns from the step 6.26 back to the step 6.1. When the count of the deflection counter $C_5$ coincides with the content of the numeral register, the deflector is brought back to its home position. Then the CPU goes from step 6.35 back to the steps 1.4 and 1.5 of FIG. **9*a*-2 as indicated by A1**.

Operated as described in actual collation and assortment, the system will deal with jamming of sheets in collators as will be discussed.

Jam detection in each collator is at two locations as previously mentioned: one which is the path extending from the inlet sheet sensor 45 to the sheet discharge sensor 94 at the deflection section, and the other which is the neighborhood of the deflector inclusive of the discharge roller pair 92.

Jamming of sheet in the conveyance path or in the vicinity of the deflector is detected at the step 6.11 or 6.14.

As jamming is detected in any of the two places, the CPU advances to step 7.1 of FIG. 9(*i*) and sets a jam flag. Then, to stop the movement of the belt 64, the CPU designates the I/O port of the belt control 165 and produces a signal for uncoupling the clutch 65 shown in FIG. 6 (step 7.2). The CPU also interrupts the sheet feed in the copying machine (step 7.3). Though not described herein, when the collator $K_1$ is jammed while the collator $K_2$ or $K_3$ is operating for collation or assortment, the collator $K_2$ or $K_3$ will stop its operation after delivering sheets in the conveyance path into a bin or bins. The CPU designates the I/O port of the drive circuit 147 associated with the inlet guide 48 and delivers thereto a signal for energizing the solenoid 47 (step 7.4), so that sheets arriving at the collator after the jamming may be discharged onto the temporary tray 50 (FIGS. 1 and 2). The solenoid 47 when energized moves the inlet guide 48 from the phantom line position to the solid line position of FIG. 2 so as to unblock the path toward the temporary tray 50. Accordingly, sheets entering the first collator $K_1$ after the jamming are directed onto the temporary tray 50 without exception. These sheets stacked on the tray 50 will be fed to the belt 64 of a specific collator afterward by using the feeder section B.

The CPU designates the I/O port of the inlet sheet sensor 45 of the first collator $K_1$ and checks reception of sheets which are actually accepted by the collator and stacked on the temporary tray (step 7.5). Every time the sheet sensor 45 detects a sheet, the CPU adds "1" to the count of the counter $C_1$ (step 7.6). Every time the detection output of the sheet sensor 45 disappears, the CPU determines whether a given period of time $T_n$ has expired after the jamming (step 7.7). This time period $T_n$ is the one which is necessary for all of copy sheets existing in the conveyance path of the copying machine to be delivered to the temporary tray 50 of the first collator $K_1$. Upon the lapse of the time period $T_n$, the CPU designates the I/O port of the jam processing lamp and produces a signal for energizing the jam display lamp 107 (step 7.8).

In the illustrated embodiment, the number of sheets n to be wasted (jammed number) due to jamming is determined as the difference between the total number of sheets transferred to the collator $K_1$ and the total number of sheets actually stored in the bins from the start of one sheet feed cycle of the copying machine under usual jam-free usual operation to the instant jamming has occurred. Stated another way, the operator wastes all of the sheets in conveyance within the collator $K_1$. This will promote operator's simple judgement concerning checking of the pages and others.

After removing the jammed sheets, the operator shifts the sheet stack on the temporary tray 50 onto the tray 60 included in the feeder section B. Then he depresses the feeder section start key 105.

Figure 10A:
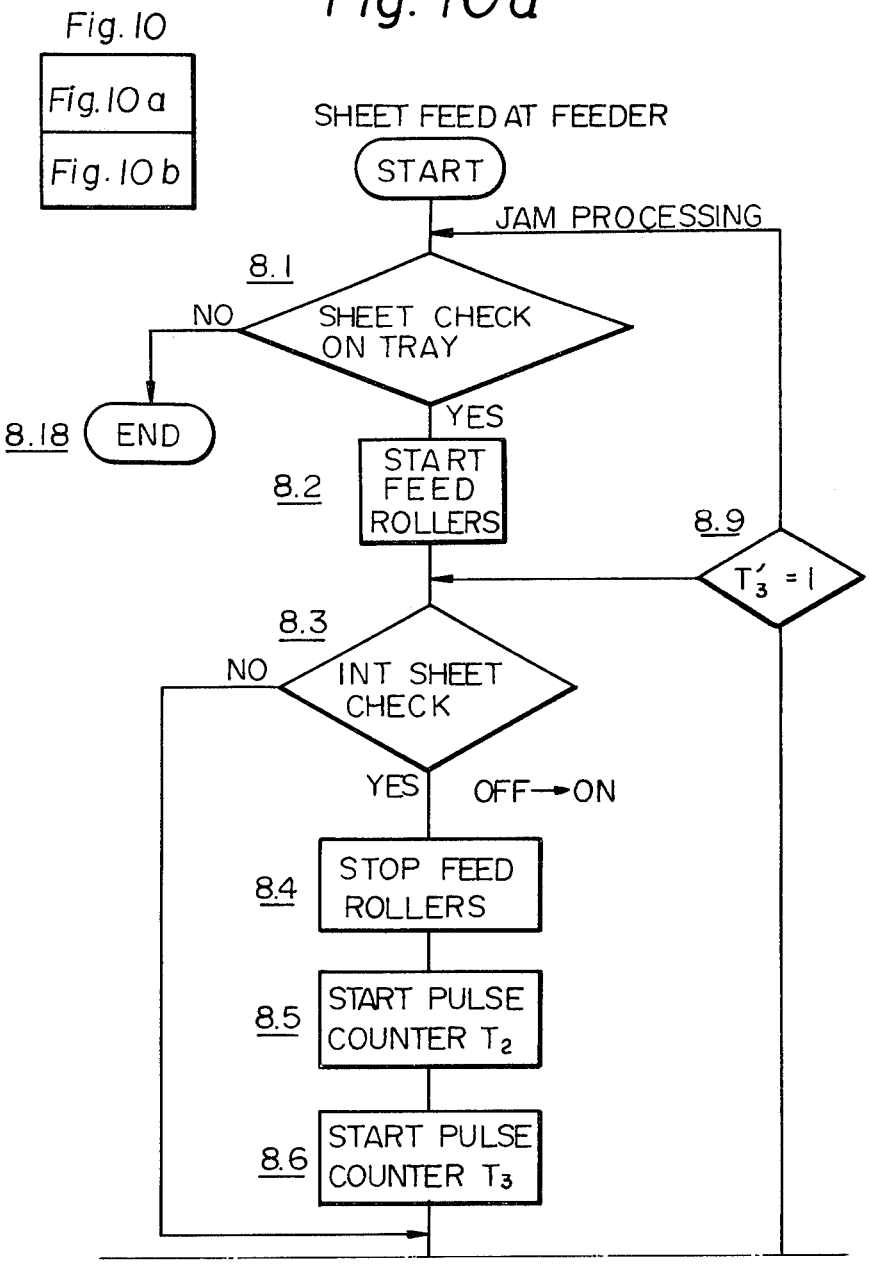
FIGS. 10*a* and 10*b* are combined to constitute a flow chart demonstrating a control method embodying the present invention.
Figure 10B:
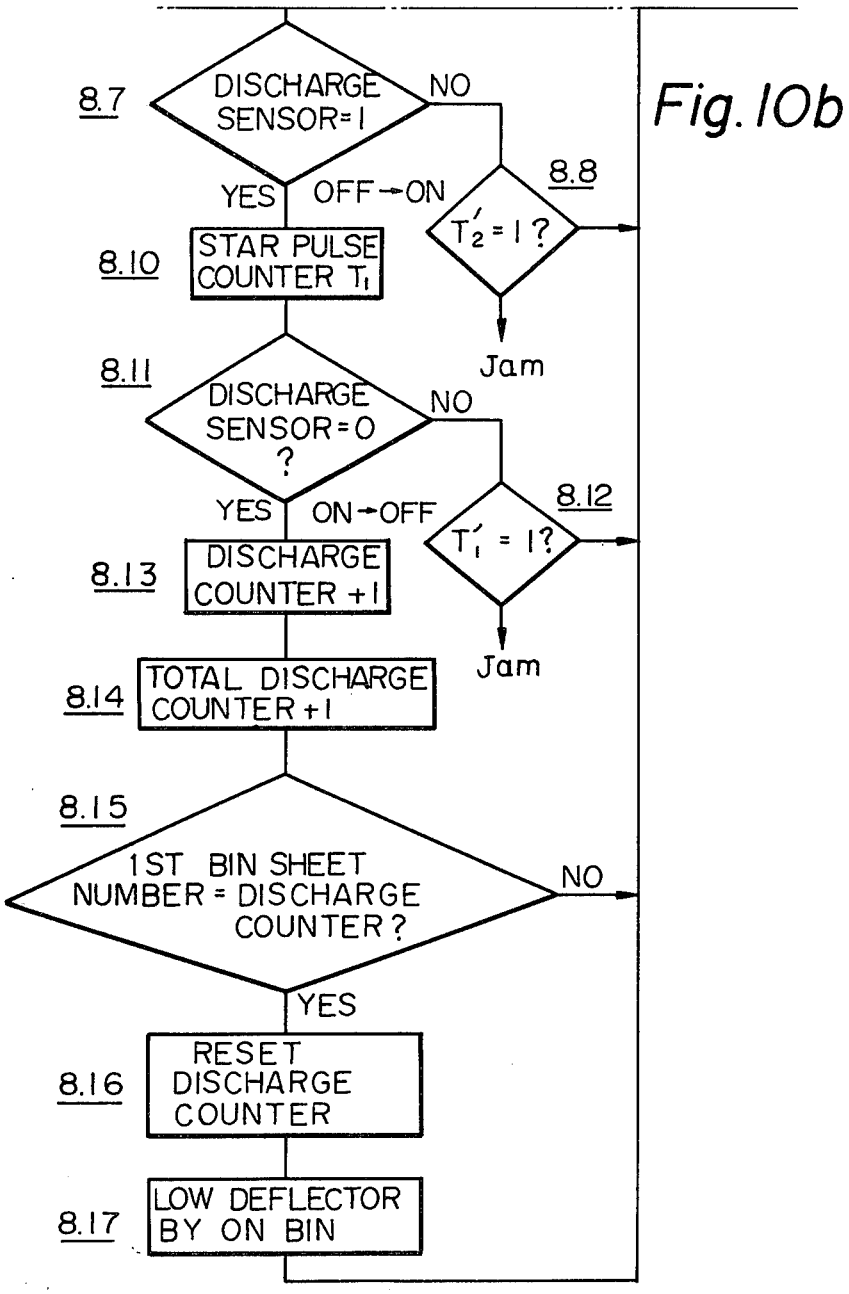

Turning to FIGS. 10*a* and 10*b*, the CPU designates the I/O port of the feeder section sheet sensor circuit 161 to determine whether sheets are loaded on the tray 60 (step 8.1). As long as the tray 60 remains loaded, the CPU keeps on delivering a clutch ON signal by designating the I/O port of the clutch drive 198 for the clutch 98 (step 8.2). Then the feed rollers 96 are rotated to feed the sheets one by one. The CPU designates the I/O port of the intermediate sheet sensor 53 to check the feed of the sheet. As the sheet sensor 53 detects the leading end of the sheet, the CPU designates the I/O port of an electromagnetic clutch drive associated with the rollers 96 and supplies a clutch OFF signal thereto (step 8.4). The CPU then designates the circuit 203 to activate the pulse counter $T_2$ and then the pulse counter $T_3$ (steps 8.5 and 8.6).

The CPU designates the I/O port of the sheet sensor 94 in the deflecting section to determine whether it has detected the sheet (step 8.7). If not, the CPU designates the circuit 203 and sees whether the pulse counter $T_2$ has reached a predetermined count $T'_2$ (step 8.8). This count $T'_2$ indicates a time period necessary for a sheet to travel from the intermediate sheet sensor 53 of the first collator $K_1$ to the sheet sensor 94 of a specific collator. If the count $T'_2$ has been reached, the CPU goes to the Jam flow (FIG. 9(*i*)) and, if not, it designates the circuit 203 to see whether the pulse counter $T_3$ has counted up to determined $T'_3$ (step 8.9). The count $T'_3$ represents a time period necessary for the rollers 96 in the feeder section to feed one copy sheet. Thus, if the interval $T'_3$ has not yet expired, the CPU returns to the intermediate sheet checking (step 8.3) determining that the sheet feed is under way. When the interval $T'_3$ is reached, the CPU returns to the step 8.1 to cause the feed of another sheet.

When at the step 8.7 the sheet sensor 94 on the deflector detects the leading end of a sheet, the pulse counter $T_1$ serving as a timer in charge of the deflecting section is activated (step 8.10). At steps 8.11 and 8.12, the CPU performs jam detection in and around the deflector. If jamming is absent, the CPU increments the counts of the counters $C_2$ and $C_3$ each by "1" (steps 8.13 and 8.14). The initial count of the counter $C_2$ indicates the number of sheets stored in the bin concerned at the instant of jamming. Then the CPU compares the count of the counter $C_2$ with the preset number M of sheets to be stored in one bin ("1" in the collation mode) (step 8.15). The above procedure is repeated until the count of the counter $C_2$ coincides with the number M. Upon coincidence, the CPU resets the counter $C_2$ (step 8.16) and lowers the deflector one module distance (step 8.17). Again, the steps 8.1–8.16 are carried out until the sheets on the tray 60 are fully fed out. This is the end of the sheet feed using the feeder section (step 8.18).

Sheet feed actions of the system will be discussed in detail hereinafter.

The copying machine 1 is so designed that it stops its operation after continuously feeding one cycle of copy sheets until the count of the fed sheet counter $C_0$ coincides with the number of volume stored in the register $S_1$ in the case of a collation mode. This means that the number of sheets fed through out one sheet feed cycle is usually equal to the number of volumes stored in the register $S_1$. However, when jamming has occurred with the jam flag made "1", the copying machine 1 interrupts the sheet supply immediately (step 7.3 in FIG. 9(*i*)). Then, after the stack of sheets on the tray 50 has been collated through the feeder section, the copying machine upon another depression of the copy start key supplies sheets of a number which is the sum of the remaining sheets in the previously interrupted one sheet feed cycle and jammed number n of sheets. In this instance, the counter $C_0$ starts counting sheets anew from the number of sheets actually stored in the bins.

The sheet feed operation of the system will be explained with reference to FIGS. 11*a* and 11*b*.

When the operator depresses the copy start key 104, the CPU first determines whether the jam flag is "1" (step 9.1). If so, the CPU subtracts the content of the total discharge counter $C_3$ from the content of the sheet feed counter $C_0$ (step 9.2) in order to obtain the number n of jammed sheets. The difference is the number n of jammed sheets. This is because the sheets in the copying machine were discharged into the tray 50 and delivered to given bins through the feeder section B. In other words, the count of the total discharge counter $C_3$ involves the number of sheets stored in the bins through the feeder section. Next, the jammed number n is subtracted from the count of the sheet feed counter $C_0$ and the count of the sheet feed counter $C_0$ is varied to one which represents the number of sheets actually delivered to the bins (step 9.3). The CPU then enters a subroutine for sheet feed start (step 9.4 and onward). If the jam flag is not "1" on the other hand, the CPU starts on the subroutine for sheet feed start without varying the content of the counter $C_0$.

The CPU sees whether the collation mode flag has been set (step 9.5). If this flag is "1" indicating a collation mode, the CPU goes to a sheet feed flow for collation mode. First the CPU in this flow checks whether the jam flag has been set (step 9.6). If the jam flag has not been set, that is, if under usual collation operation, the CPU resets the sheet feed counter $C_0$ and starts on checking of sheet in the sheet feed section. If there exist jammed sheets with the jam flag thus made "1", the CPU goes to a sheet check in the sheet feed section without resetting the sheet feed counter $C_0$. It will therefore be seen that, when there had occurred jamming and the sheet feed has started afterward, the content of the sheet feed counter $C_0$ is the numerical value modified at the step 9.3 (common to the content of the total discharge counter $C_3$).

Then the CPU carries out a sheet check in the sheet feed section (step 10.1) and, when the sheet sensor 22 detects a sheet, the CPU increments the count of the sheet feed counter $C_0$ by one (step 10.2). In this way, the count of the counter $C_0$ increments from the initial count "0" in the case of usual one sheet feed cycle or from the initial count modified at the step 9.3 at the start of a sheet feed after jamming of sheets. The CPU determines whether the $P_2$ flag is set (step 10.3). If not, the CPU designates the circuit 204 and causes the display B 109 to show the content of the counter $C_0$ each time because setting of the $P_2$ flag indicates a usual sheet feed operation (step 10.4). If the $P_2$ flag is set, the CPU adds the content of the register $S_3$ to that of the counter $C_0$ and designates the circuit 204 to show the sum on the display B (step 10.5). It follows that, when the $P_2$ flag is set and if 25 volumes are to be collated with only one collator available and which is empty, the counter $C_0$ will not return to "0" but hold "20" at the end of the first collation and then count the first sheet in the second collation as "21".

The CPU determines whether the count of the sheet feed counter $C_0$ is identical with the number of volumes, i.e. content of the register $S_1$ (step 10.6). If not, the CPU returns to the step 10.1 and performs a sheet check in the sheet feed section. With this procedure repeated, the numerical value indicated on the display B increases one by one for each sheet feed. Coincidence of the count of the counter $C_0$ with the content of the register $S_1$ teaches that the remaining proportion of the sheets inclusive of the wasted number n of sheets has been fully supplied or that one normal sheet feed cycle has completed. Then the CPU resets the jam flag and completes the sheet feed for collation (step 10.7).

Now, when at the step 9.5 the CPU identifies the operation mode as an assortment mode, it advances to step 11.1 to perform a sheet check in the sheet feed section. Every time a sheet is detected, the count of the sheet feed counter $C_0$ increments one and the varying count is displayed on the display B (step 11.2 and 11.3). Then the CPU checks whether the count of the counter $C_0$ has coincided with the content of the numeral register, i.e. total number of copies (step 11.4). The initial count of the counter $C_0$ is "0" if the sheet feed action is usual one but it will be the value determined at the step 9.3 if it is a sheet feed action after jamming. Accordingly, in the latter case, assortment will complete upon coincidence of the count of the counter $C_0$ with the content of the numeral register. Then the CPU resets the jam flag and interrupts the sheet feed for assortment (step 11.5).

If the count of the counter $C_0$ does not coincide with the content of the numeral register, the CPU checks whether the "count 20" flag of the deflection counter is set (step 11.6). Since this flag is to be set and become "1" when the deflector reaches the final 20th bin (step 6.24), sheets will be continuously fed as long as the flag remains reset, that is, as long as the collator has an empty bin or bins (step 11.6). If the "count 20" flag of the deflection counter is "1", the CPU determines whether the count of the counter $C_0$ has coincided with the number M of sheets to see whether the "M" sheets have been fully supplied into the 20th bin. Sheets are fed in succession until the two counts coincide with each other. Their coincidence indicates the full assortment of sheets down to the 20th bin and, at this instant, the CPU resets the jam flag and "count 0" flag of the deflection counter to stop the sheet feed operation (steps 11.8 and 11.9).

The above-mentioned sheet feed operation for assortment has made up for the loss of "n" jammed sheets.

Paying attention to the displays A and B alone, let us now discuss the operation in collation mode taking 25 volumes of sheets for example.

Suppose that two or more empty collators are available to permit collation of all the 25 volumes by one collation.

Figure 12B:
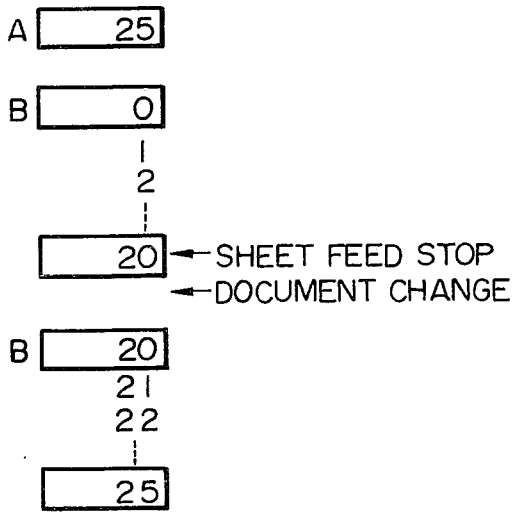
FIGS. 12*a* and 12*b* are diagrams showing examples of numerical indications on display sections in a collation mode.
Figure 12A:
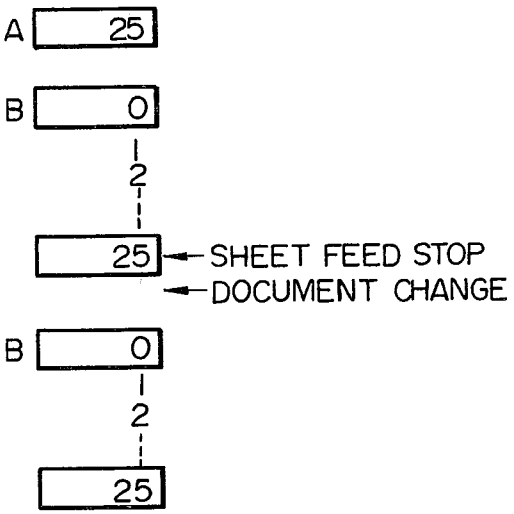

Turning to FIG. 12(*a*), the operator first depresses numeral keys so that the display A indicates the desired number of copies (volumes=25). The initial value on the display B is zero. After the depression of the copy start key and every time a copy sheet is fed, the numerical value on the display B increments one. The sheet feed is interrupted as the count of the counter $C_0$ reaches "25" which is also indicated on the display B. Then the operator replaces the document by another of the next page and depresses the copy start key. The value on the display B is now "0" again. This procedure will be repeated until the collation completes with copy sheets on all the desired pages fed out. In the meantime, the indication on the display A which is "25" does not vary.

Next, suppose that only one collator is connected with the copying machine and, therefore, one collating operation cannot process 25 volumes of sheets even though the collator may be empty.

Referring to FIG. 12(*b*), that the operator first sets the number of copies (volumes=25) on the display A and that the initial value on the display B is zero are the same as the preceding case. The sheet feed section of the copying machine first supplies one collator or 20 bins of sheets. After the depression of the copy start key, the value on the display B increments one every time a copy sheet is supplied to the collator. When the value on the display B reaches "20", the sheet feed is interrupted. Then the display B returns to "0" and again starts counting up one by one up to "20", when the sheet feed will be stopped again. This procedure is repeated until 20 volumes of sheets are fully collated. Thereafter, the operator takes the copy stacks out of the respective bins of the collator. During this period, the indication "25" on the display A does not change.

Upon another depression of the copy start key, the numerical value "20" on the display B does not vary. Afterward, the display B counts up from "20" up to "25" and, at this instant, the sheet feed from the copying machine is interrupted. Then the document is replaced by the third page and the copy start key is depressed. This brings the value on the display B back to "20" whereupon the display B starts counting up one by one. When the display reaches "25", the sheet feed is suspended. Such actions will be repeated to collate the remaining five volumes of copy sheets. In the meantime, the indication "25" on the display A remains the same.

In an assortment mode on the other hand, the operator first introduces a desired number of copies (total number of copies) through numeral keys and the display A indicates it thereon. Assume that the copy number desired is "125".

Figure 13A:
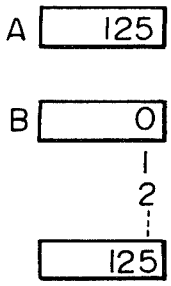
FIGS. 13*a* and 13*b* are diagrams showing examples of numerical indications on display sections in an assortment mode.
Figure 13B:
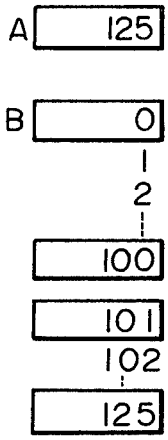

Whether the 125 copy sheets can be assorted at a time depends on the number M of sheets to be stored in each bin and on the position of a bin in the arry with which the deflector has aligned. Where the volumes to be assorted are 20 or less which the 20 bins can accommodate, the display B as shown in FIG. 13(*b*) increments its count one by one from "0" and the sheet feed is stopped when the counter $C_0$ and therefore the display B reach "125". The display A holds the same value in this period of time. The desired volumes of sheets can be assorted in this way.

When empty bins have run out during assortment such as after the delivery of the 100th copy sheet as shown in FIG. 13(*b*) (which corresponds to the 20th bin), the sheet feed stops with the count "100" of the counter $C_0$ indicated on the display B. After removal of copy stacks from the bins or if another empty collator is available, the copy start key will be depressed again to copy and assort the remaining 25 sheets. Then the display B will further count up from "100" and finally indicate "125".

In summary, it will be seen that the present invention provides an improved sheet number display control method which, when a desired number of volumes to be collated is larger than the effective processing ability of collators which are all empty, divides the volume number and stores them in first and second registers $S_1$ and $S_2$. The $S_1$ register stores the number of volumes which corresponds to the total number of bins of all the collators to be used first and this part of the entire volumes is processed first. After the collation of these volumes, the content of a display B further increments to indicate the relation between the processed part and the remaining part and inform the operator of this relation while the remaining part of the volumes is processed. Accordingly, the operator is freed from troublesome judgement and manipulation such as in removing sheet stacks from bins.

Various modifications will become possible for those skilled in the art after receiving the teachings of the present disclosure without departing from the scope thereof.

What is claimed is:

1. A sheet distribution method for collating a plurality of sets of copies produced by a copying machine into respective bins of a collating apparatus operatively connected to the copying machine, each set of copies consisting of one copy of each respective page of an original document, comprising the steps of:

(a) providing first display means;

(b) displaying a total number of sets of copies to be produced and collated on the first display means;

(c) computing whether the total number of sets is greater than a number of available bins in the collating apparatus;

(d) when the total number of sets is smaller than the number of available bins, collating the sets of copies into the respective bins in a single collation operation;

(e) when the total number of sets is greater than the number of available bins, collating the sets of copies into the respective bins in a plurality of successive collation operations;

(f) providing second display means;

(g) during collation of copies of a page of the document by the collating apparatus, computing a total number of copies of said page which have been collated; and (h) displaying the total number of copies on the second display means.

2. A method as in claim 1, in which step (g) comprises counting a number of copies of said page which have been collated during a present collation operation to provide a count, computing a previous number of sets of copies which were collated during previous collation operations and adding said count to the previous number of sets to provide the total number of copies.

3. An apparatus as in claim 1, in which the collating apparatus comprises a plurality of collators, the method further comprising the step, performed prior to step (c), of:

(i) determining the number of available bins by sensing for an available status of each collator.

4. An apparatus as in claim 3, further comprising the step, performed after step (i), of:

(j) inhibiting collation when the number of available bins is zero.

* * * * *